US011163243B2

(12) United States Patent
Shimizu et al.

(10) Patent No.: US 11,163,243 B2
(45) Date of Patent: Nov. 2, 2021

(54) IMAGE FORMING APPARATUS

(71) Applicant: KYOCERA Document Solutions Inc., Osaka (JP)

(72) Inventors: Tamotsu Shimizu, Osaka (JP); Norio Kubo, Osaka (JP); Asami Sasaki, Osaka (JP); Yasuhiro Tauchi, Osaka (JP); Yuji Toyota, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/206,261

(22) Filed: Mar. 19, 2021

(65) Prior Publication Data

US 2021/0302867 A1 Sep. 30, 2021

(30) Foreign Application Priority Data

Mar. 25, 2020 (JP) ..... JP2020-053843

(51) Int. Cl.
*G03G 15/06* (2006.01)

(52) U.S. Cl.
CPC ..... *G03G 15/065* (2013.01)

(58) Field of Classification Search
CPC ..... G03G 15/065
See application file for complete search history.

(56) References Cited

U.S. PATENT DOCUMENTS 5,911,098 A * 6/1999 Gyotoku ..... G03G 15/0803 399/264
2014/0301749 A1* 10/2014 Fukusaka ..... G03G 15/065 399/55
2014/0301750 A1* 10/2014 Fukusaka ..... G03G 15/065 399/55
2016/0187802 A1* 6/2016 Kagawa ..... G03G 15/0189 399/89
2018/0341205 A1* 11/2018 Fujihara ..... G03G 15/065

FOREIGN PATENT DOCUMENTS

JP H05-107835 4/1993
JP 2015-203731 11/2015

* cited by examiner

*Primary Examiner* — Sevan A Aydin
(74) *Attorney, Agent, or Firm* — Lex IP Meister, PLLC

(57) ABSTRACT

A bias condition determiner executes, in order, a first direct current voltage determination mode (first DC calibration) for determining a provisional reference direct current voltage that is a provisional reference for a direct current voltage of a developing bias applied to a developing roller, an inter-peak voltage determination mode (AC calibration) for determining a reference inter-peak voltage that is a reference for an inter-peak voltage of an alternating current voltage of the developing bias applied to the developing roller in an image forming operation, and a second direct current voltage determination mode (second DC calibration) for determining a reference direct current voltage that is a reference for the direct current voltage of the developing bias applied to the developing roller in the image forming operation.

16 Claims, 16 Drawing Sheets

IMAGE FORMING APPARATUS

INCORPORATION BY REFERENCE

This application is based upon, and claims the benefit of priority from, corresponding Japanese Patent Application No. 2020-053843 filed in the Japan Patent Office on Mar. 25, 2020, the entire contents of which are incorporated herein by reference.

BACKGROUND

Field of the Invention

The present disclosure relates to an image forming apparatus including a developing device to which a two-component development method is applied.

Description of Related Art

Typically, as an image forming apparatus for forming an image on a sheet, an image forming apparatus including a photoconductor drum (image carrier), a developing device, and a transfer member is known. When the electrostatic latent image formed on the photoconductor drum is actualized by toner by the developing device, a toner image is formed on the photoconductor drum. The toner image is transferred to a sheet by the transfer member. As a developing device applied to such an image forming apparatus, a two-component development technique using a developer containing toner and carrier is known.

In the two-component development technique, a developing device includes a developing roller, and a suitable toner image is formed by applying a developing bias in which an AC bias is superimposed on a DC bias to the developing roller. Typically, there is known a technique for measuring the image density of a half-tone image while changing a DC bias and selecting a DC bias at which a target image density can be obtained from the characteristics.

SUMMARY

The image forming apparatus according to one aspect of the present disclosure is an image forming apparatus capable of performing an image forming operation for forming an image on a sheet, and includes an image carrier, a charging device, an exposure device, a developing device, a transferer, a developing bias applicator, a current detector, a density detector, and a bias condition determiner. The image carrier includes a surface that is rotated to allow an electrostatic latent image to be formed and carries a toner image in which an electrostatic latent image is actualized by toner. The charging device charges the image carrier to a specific charging potential. The exposure device is disposed on a downstream side in a rotation direction of the image carrier with respect to the charging device, and forms the electrostatic latent image by exposing a surface of the image carrier that is charged to the charging potential in accordance with specific image information. The developing device is disposed to face the image carrier in a specific developing nip section on the downstream side in the rotation direction with respect to the exposure device, and includes a developing roller that includes a peripheral surface rotated and carrying a developer including toner and carrier, and to supply toner to the image carrier to thereby form the toner image. The transferer transfers the toner image carried on the image carrier to a sheet. The developing bias applicator can apply a developing bias in which an alternating current voltage is superimposed on a direct current voltage to the developing roller. The current detector can detect a direct current component of a developing current flowing between the developing roller and the developing bias applicator. The density detector can detect a density of the toner image. The bias condition determiner executes a bias condition determination mode for determining a reference voltage that is a reference for each of an inter-peak voltage of the alternating current voltage of the developing bias applied to the developing roller in the image forming operation and the direct current voltage, on a basis of the direct current component of the developing current detected by the current detector or a density of a toner image for measurement detected by the density detector when the developing bias is applied to the developing roller corresponding to a specific latent image for measurement formed on the image carrier to develop with toner the latent image for measurement into the toner image for measurement. The bias condition determiner executes, as the bias condition determination mode, each of a first direct current voltage determination mode, an inter-peak voltage determination mode, and a second direct current voltage determination mode. The first direct current voltage determination mode is for determining a provisional reference direct current voltage that is a provisional reference for the direct current voltage of the developing bias applied to the developing roller, on a basis of the density of the toner image for measurement, detected by the density detector. The inter-peak voltage determination mode is executed after the first direct current voltage determination mode, and is for determining a reference inter-peak voltage that is a reference for the inter-peak voltage of the alternating current voltage of the developing bias applied to the developing roller in the image forming operation, on a basis of the direct current component of the developing current detected by the current detector or a density of a toner image for measurement detected by the density detector when the developing bias including the provisional reference direct current voltage is applied to the developing roller to develop with toner the latent image for measurement into the toner image for measurement. The second direct current voltage determination mode is executed after the inter-peak voltage determination mode, and is for determining a reference direct current voltage that is a reference for the direct current voltage of the developing bias applied to the developing roller in the image forming operation, on a basis of a density of a toner image for measurement detected by the density detector when the developing bias including the reference inter-peak voltage is applied to the developing roller to develop with toner the latent image for measurement into the toner image for measurement.

DETAILED DESCRIPTION

Hereinafter, an image forming apparatus 10 according to an embodiment of the disclosure will be described in detail on the basis of the drawings. In the present embodiment, a tandem type color printer is illustrated as an example of the image forming apparatus. The image forming apparatus may be, for example, a copying machine, a fax machine, or a multifunction machine of these. In addition, the image forming apparatus may be an image forming apparatus for forming a mono-color (monochrome) image. The image forming apparatus 10 is capable of executing an image forming operation for forming an image on a sheet P.

Figure 1:
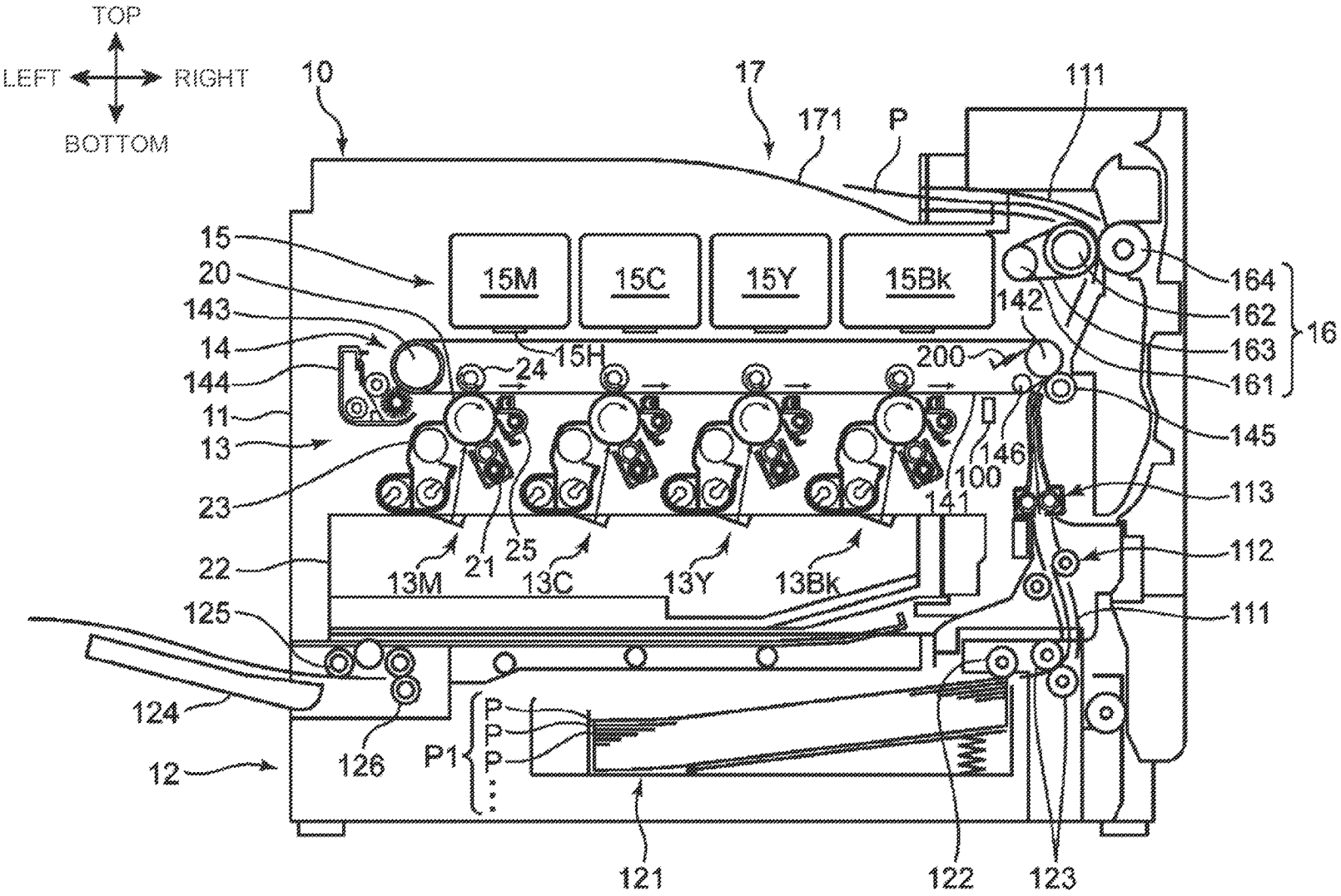
FIG. 1 is a cross-sectional view illustrating the internal structure of an image forming apparatus according to an embodiment of the present disclosure.

FIG. 1 is a cross-sectional view illustrating the internal structure of an image forming apparatus 10. This image forming apparatus 10 includes an apparatus main body 11 including a box-shaped housing structure. In this apparatus main body 11, a paper feeder 12 that feeds the sheet P, an image former 13 that forms a toner image to be transferred to the sheet P fed from the paper feeder 12, an intermediate transfer unit 14 (transferer) to which the toner image is primarily transferred, a toner replenisher 15 that replenishes toner to the image former 13, and a fixer 16 that performs a process to fix the unfixed toner image formed on the sheet P to the sheet P are installed. Furthermore, a paper ejector 17 is included on the upper part of the apparatus main body 11 to eject the sheet P that has been subjected to the fixing process by the fixer 16.

An operation panel (not illustrated) for inputting and operating the output conditions for the sheet P is provided at an appropriate position on the upper surface of the apparatus main body 11. This operation panel is equipped with a power key, a touch panel for inputting output conditions, and various operation keys.

In the apparatus main body 11, a sheet conveyance path 111 extending in the up-down direction is further formed on the right side of the image former 13. The sheet conveyance path 111 is provided with a conveyance roller pair 112 that conveys a sheet in place. In addition, a resist roller pair 113 that performs skew correction of the sheet and feeds the sheet to the nip section of the secondary transfer described later at a specific timing is provided on the upstream side of the nip section in the sheet conveyance path 111. The sheet conveyance path 111 is a conveyance path that conveys the sheet P from the paper feeder 12 to the paper ejector 17 via the image former 13 and the fixer 16.

The paper feeder 12 includes a paper feed tray 121, a pick-up roller 122, and a paper feed roller pair 123. The paper feed tray 121 is detachably mounted in the lower position of the apparatus main body 11 and stores a sheet bundle in which a plurality of sheets P1 are stacked. The pick-up roller 122 feeds out the sheet P1 on the uppermost surface of the sheet bundle stored in the paper feed tray 121 one by one. The paper feed roller pair 123 sends the sheet P fed out by the pick-up roller 122 to the sheet conveyance path 111.

The paper feeder 12 includes a manual paper feeder that is attached to the left side surface of the apparatus main body 11 illustrated in FIG. 1. The manual paper feeder 12 includes a manual feed tray 124, a pick-up roller 125, and a paper feed roller pair 126. The manual feed tray 124 is a tray on which the manually fed sheet P is placed, and when the sheet P is manually fed, the manual feed tray 124 is released from the side surface of the apparatus main body 11 as illustrated in FIG. 1. The pick-up roller 125 feeds out the sheet P placed on the manual feed tray 124. The paper feed roller pair 126 sends the sheet P fed by the pick-up roller 125 to the sheet conveyance path 111.

The image former 13 forms a toner image to be transferred to the sheet P, and includes a plurality of image forming units that form toner images of different colors. As this image forming unit, in the present embodiment, a magenta unit 13M using a magenta (M) color developer, a cyan unit 13C using a cyan (C) color developer, a yellow unit 13Y using a yellow (Y) color developer, and a black unit 13Bk using a black (Bk) color developer are included, being sequentially arranged from the upstream side to the downstream side (from the left side to the right side illustrated in FIG. 1) in the rotation direction of an intermediate transfer belt 141 described later. Each unit 13M, 13C, 13Y, and 13Bk respectively includes a photoconductor drum 20 (image carrier), a charging device 21, a developing device 23, a primary transfer roller 24, and a cleaning device 25 arranged around the photoconductor drum 20. In addition, an exposure device 22 common to each unit 13M, 13C, 13Y, and 13Bk is disposed below the image forming unit.

The photoconductor drum 20 includes a cylindrical surface that is rotated about the axis thereof to allow an electrostatic latent image to be formed and carries a toner image in which the electrostatic latent image is actualized by toner. As this photoconductor drum 20, as an example, a known amorphous silicon (α-Si) photoconductor drum or an organic (OPC) photoconductor drum is used. The charging device 21 uniformly charges the surface of the photoconductor drum 20 to a specific charging potential. The charging device 21 includes a charging roller and a charging cleaning brush for removing toner adhering to the charging roller. The exposure device 22 is disposed on the downstream side in the rotation direction of the photoconductor drum 20 with respect to the charging device 21, and includes various optical system devices such as a light source, a polygon mirror, a reflection mirror, and a deflection mirror. The exposure device 22 irradiates the surface of the photoconductor drum 20 uniformly charged to the charging potential, with light modulated on the basis of image data (specific image information) to expose the surface, thereby forming an electrostatic latent image.

The developing device 23 is disposed to face the photoconductor drum 20 at a specific developing nip section NP (FIG. 3A) on the downstream side in the rotation direction of the photoconductor drum 20 with respect to the exposure device 22. The developing device 23 includes a developing roller 231. The developing roller 231 includes a peripheral surface which is rotated and carries a developer including toner and carrier, and which supplies toner to the photoconductor drum 20 to thereby form the toner image.

The primary transfer roller 24 forms a nip section with the photoconductor drum 20 by sandwiching the intermediate transfer belt 141 included in the intermediate transfer unit 14. Furthermore, the primary transfer roller 24 primarily transfers the toner image on the photoconductor drum 20 onto the intermediate transfer belt 141. The cleaning device 25 cleans the peripheral surface of the photoconductor drum 20 after the toner image is transferred.

The intermediate transfer unit 14 is disposed in a space provided between the image former 13 and the toner replenisher 15, and includes the intermediate transfer belt 141, a drive roller 142 rotatably supported by a unit frame (not illustrated), a driven roller 143, a backup roller 146, and a density sensor 100. The intermediate transfer belt 141 is an endless belt-shaped rotating body, and is bridged over the drive roller 142, the driven roller 143, and the backup roller 146 in such a manner that the peripheral surface side of the intermediate transfer belt 141 abuts on the peripheral surface of each photoconductor drum 20. The intermediate transfer belt 141 is circularly driven by the rotation of the drive roller 142. In the vicinity of the driven roller 143, a belt cleaning device 144 that removes the toner remaining on the peripheral surface of the intermediate transfer belt 141 is disposed. The density sensor 100 (density detector) is disposed on the downstream side of the units 13M, 13C, 13Y, and 13Bk so as to face the intermediate transfer belt 141, and detects the density of the toner image formed on the intermediate transfer belt 141 by reflected light (reflection type). In an other embodiment, the density sensor 100 may detect the density of the toner image on the photoconductor drum 20 or may detect the density of the toner image fixed on the sheet P.

A secondary transfer roller 145 is disposed outside the intermediate transfer belt 141, facing the drive roller 142. The secondary transfer roller 145 is pressed against the peripheral surface of the intermediate transfer belt 141 to form a transfer nip section with the drive roller 142. The toner image primarily transferred onto the intermediate transfer belt 141 is secondarily transferred to the sheet P fed from the paper feeder 12 at the transfer nip section. That is, the intermediate transfer unit 14 and the secondary transfer roller 145 function as a transferer that transfers the toner image carried on the photoconductor drum 20 to the sheet P. In addition, a roll cleaner 200 for cleaning the peripheral surface of the drive roller 142 is disposed in the drive roller 142.

The toner replenisher 15 stores the toner used for image formation, and in the present embodiment, includes the toner container 15M for magenta, the toner container 15C for cyan, the toner container 15Y for yellow, and the toner container 15Bk for black. These toner containers 15M, 15C, 15Y, and 15Bk each store the toner for replenishment of each color of M/C/Y/Bk. From a toner discharge port 15H formed on the bottom surface of the container, the toner of each color is replenished to the developing device 23 of the image forming unit 13M, 13C, 13Y, and 13Bk corresponding to each color of M/C/Y/Bk.

The fixer 16 includes a heating roller 161 including a heating source inside, a fixing roller 162 disposed to face the heating roller 161, a fixing belt 163 stretched between the fixing roller 162 and the heating roller 161, and a pressure roller 164 that is disposed to face the fixing roller 162 via the fixing belt 163 and forms a fixing nip section. The sheet P fed to the fixer 16 is heated and pressurized by passing through the fixing nip section. As a result, the toner image transferred to the sheet P at the transfer nip section is fixed to the sheet P.

The paper ejector 17 is formed by denting the top of the apparatus main body 11, and a paper ejection tray 171 for receiving the ejected sheet P is formed at the bottom of the dented portion. The sheet P that has been subjected to the fixing process is ejected to the paper ejector 151 via the sheet conveyance path 111 that extends from the upper part of the fixer 16.

<Developing Device>

Figure 2:
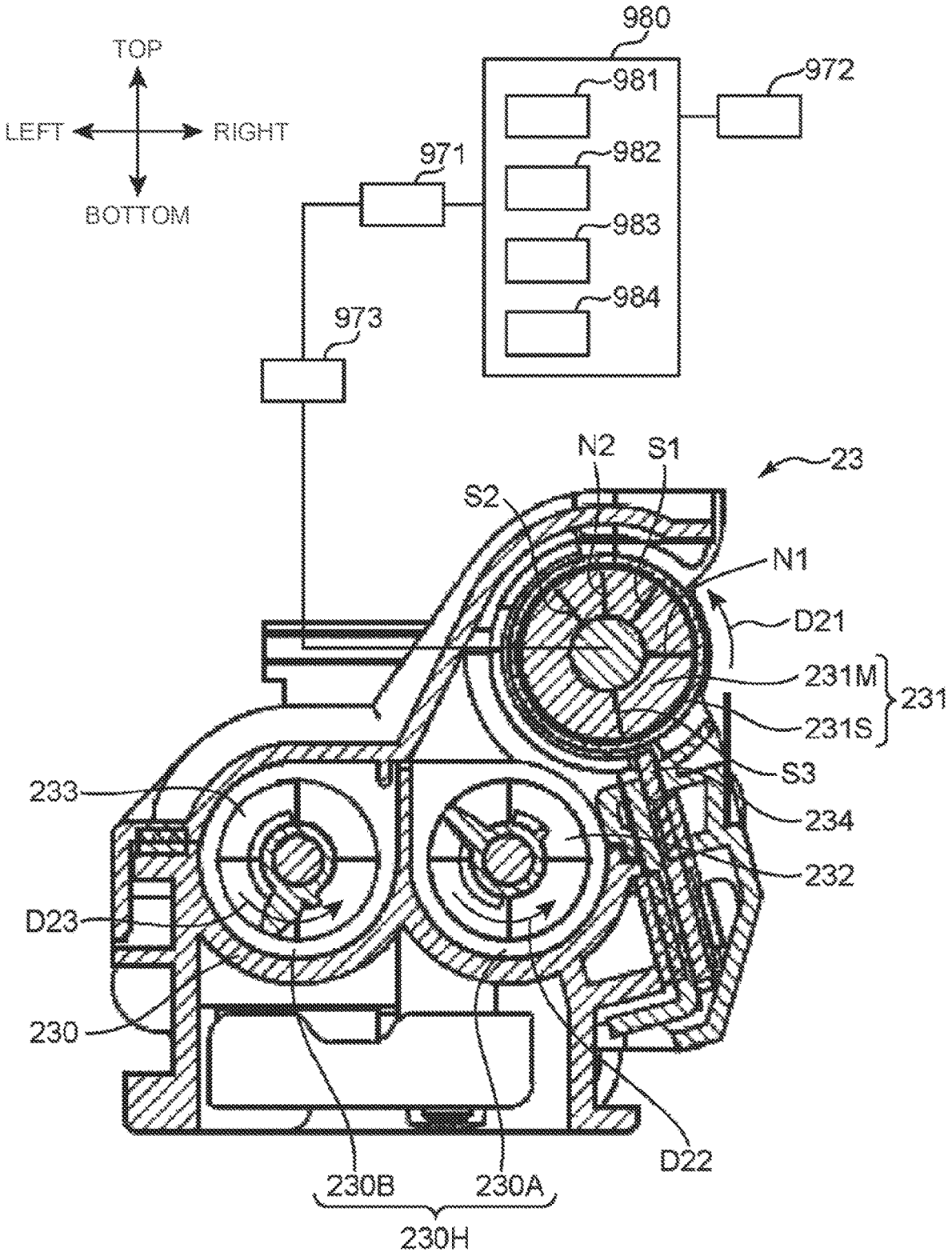
FIG. 2 is a cross-sectional view of a developing device according to the embodiment of the present disclosure and a block diagram illustrating the electrical configuration of a controller.

FIG. 2 is a cross-sectional view of a developing device 23 according to the present embodiment and a block diagram illustrating the electrical configuration of a controller 980. The developing device 23 includes a developing housing 230, a developing roller 231 and a first screw feeder 232, a second screw feeder 233, and a regulation blade 234. A two-component development method is applied to the developing device 23.

The developing housing 230 includes a developer container 230H. The developer container 230H contains a two-component developer including toner and carrier. In addition, the developer container 230H includes a first conveyer 230A in which the developer is conveyed in a first conveyance direction (direction orthogonal to the paper surface in FIG. 2, the direction from rear to front) from one end side to the other end side in the axial direction of the developing roller 231 and a second conveyer 230B which communicates with the first conveyer 230A at both ends in the axial direction and in which the developer is conveyed in a second conveyance direction opposite to the first conveyance direction. The first screw feeder 232 and the second screw feeder 233 are rotated in the directions of arrows D22 and D23 in FIG. 2, and convey the developer in the first conveyance direction and the second conveyance direction, respectively. In particular, the first screw feeder 232 supplies the developer to the developing roller 231 while conveying the developer in the first conveyance direction.

Figure 3A:
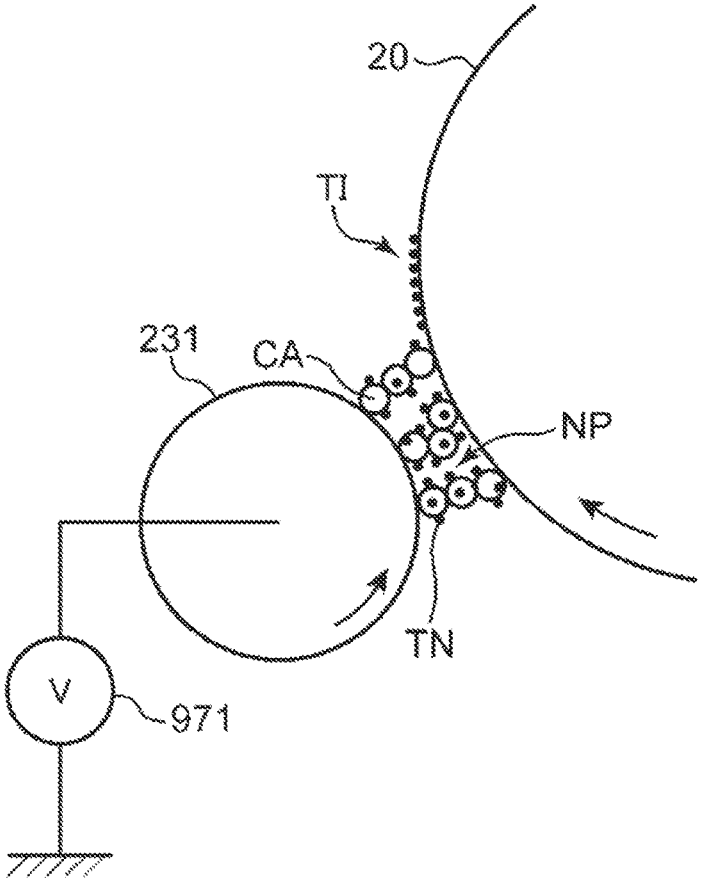
FIG. 3A is a schematic diagram illustrating the developing operation of the image forming apparatus according to the embodiment of the present disclosure.

The developing roller 231 is disposed to face the photoconductor drum 20 in the developing nip section NP (FIG. 3A). The developing roller 231 includes a rotating sleeve 231S and a magnet 231M fixedly arranged inside the sleeve 231S. The magnet 231M includes S1, N1, S2, N2 and S3 poles. The N1 pole functions as the main pole, the S1 pole and N2 pole function as a conveyance pole, and the S2 pole functions as a peeling pole. In addition, the S3 pole functions as a pumping pole and a regulating pole. As an example, the magnetic flux densities of the S1 pole, N1 pole, S2 pole, N2 pole, and S3 pole are set to 54 mT, 96 mT, 35 mT, 44 mT, and 45 mT. The sleeve 231S of the developing roller 231 is rotated in the direction of an arrow D21 in FIG. 2. The developing roller 231 is rotated, receives the developer in the developing housing 230, carries the developer layer, and supplies toner to the photoconductor drum 20. In the present embodiment, the developing roller 231 rotates in the same direction (with direction) at a position facing the photoconductor drum 20. In addition, in the axial direction (width direction) of the developing roller 231, the range in which the magnetic brush of the two-component developer is formed is 304 mm as an example.

The regulation blades 234 are disposed on the developing roller 231 at specific intervals, and regulate the layer thickness of the developer supplied from the first screw feeder 232 onto the peripheral surface of the developing roller 231.

The image forming apparatus 10 including the developing device 23 further includes a developing bias applicator 971, a driver 972, an ammeter 973 (current detector), and a controller 980. The controller 980 includes a central processing unit (CPU), a read only memory (ROM) for storing control programs, and a random access memory (RAM) used as a work area of the CPU.

The developing bias applicator 971 includes a direct current power supply and an alternating current power supply, and applies to the developing roller 231 of the developing device 23, a developing bias in which an alternating current voltage (AC bias) is superimposed on a direct current voltage (DC bias), on the basis of the control signal from a bias controller 982 described later.

The driver 972 includes a motor and a gear mechanism for transmitting the torque of the motor, and rotationally drives the developing roller 231 in the developing device 23, the first screw feeder 232, and the second screw feeder 233 in addition to the photoconductor drum 20 during the developing operation, in response to a control signal from a drive controller 981 described later.

The ammeter 973 detects the direct current (direct current component of the developing current) flowing between the developing roller 231 and the developing bias applicator 971.

The controller 980 functions so as to include a drive controller 981, a bias controller 982, a storage unit 983, and a calibration executor 984 (bias condition determiner) by executing the control programs stored in the ROM by the CPU.

The drive controller 981 controls the driver 972 to rotationally drive the developing roller 231, the first screw feeder 232, and the second screw feeder 233. In addition, the drive controller 981 controls a drive mechanism (not illustrated) to rotationally drive the photoconductor drum 20.

The bias controller 982 controls the developing bias applicator 971 during the developing operation (during the image forming operation) in which the toner is supplied from the developing roller 231 to the photoconductor drum 20, to provide a potential difference of a direct current voltage and an alternating current voltage between the photoconductor drum 20 and the developing roller 231. Due to the potential difference, the toner is moved from the developing roller 231 to the photoconductor drum 20.

The storage unit 983 stores various information referred to by the drive controller 981, the bias controller 982, and the calibration executor 984. As an example, the rotation speed of the developing roller 231 and the value of the developing bias adjusted in accordance with the environment are stored. In addition, the storage unit 983 stores the print rate and the number of lines set in accordance with each toner image when a plurality of toner images for measurement are formed on the photoconductor drum 20. The data stored in the storage unit 983 may be in the form of a graph or table.

The calibration executor 984 executes the developing bias calibration including a DC calibration and an AC calibration described later.

In addition, the calibration executor 984 forms a plurality of toner images for measurement on the photoconductor drum 20 while controlling the photoconductor drum 20, the charging device 21, the exposure device 22, and the developing device 23 in the AC calibration. Then, the calibration executor 984 determines a reference inter-peak voltage that is a reference for the inter-peak voltage of the alternating current voltage of the developing bias applied to the developing roller 231 in the image forming operation, on the basis of the direct current detected by the ammeter 973 when the developing bias is applied to the developing roller 231 corresponding to a specific latent image for measurement formed on the photoconductor drum 20 to develop with toner the latent image for measurement into a toner image for measurement. In the DC calibration or image forming operation after the AC calibration is performed, the above reference inter-peak voltage may be used as it is, or the reference inter-peak voltage multiplied by a specific safety factor may be used.

<Developing Operation>

Figure 3B:
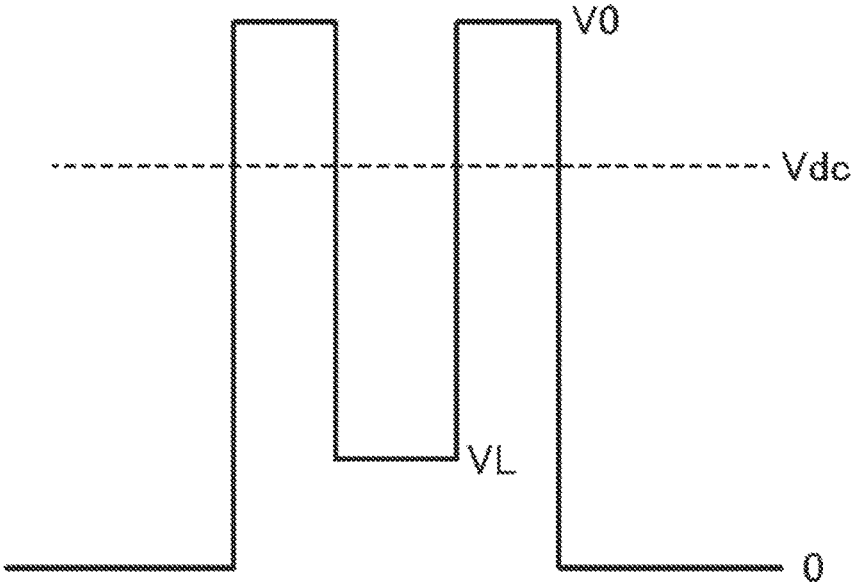
FIG. 3B is a schematic diagram illustrating the magnitude relation between the potentials of an image carrier and a developing roller according to the embodiment of the present disclosure.
Figure 3C:
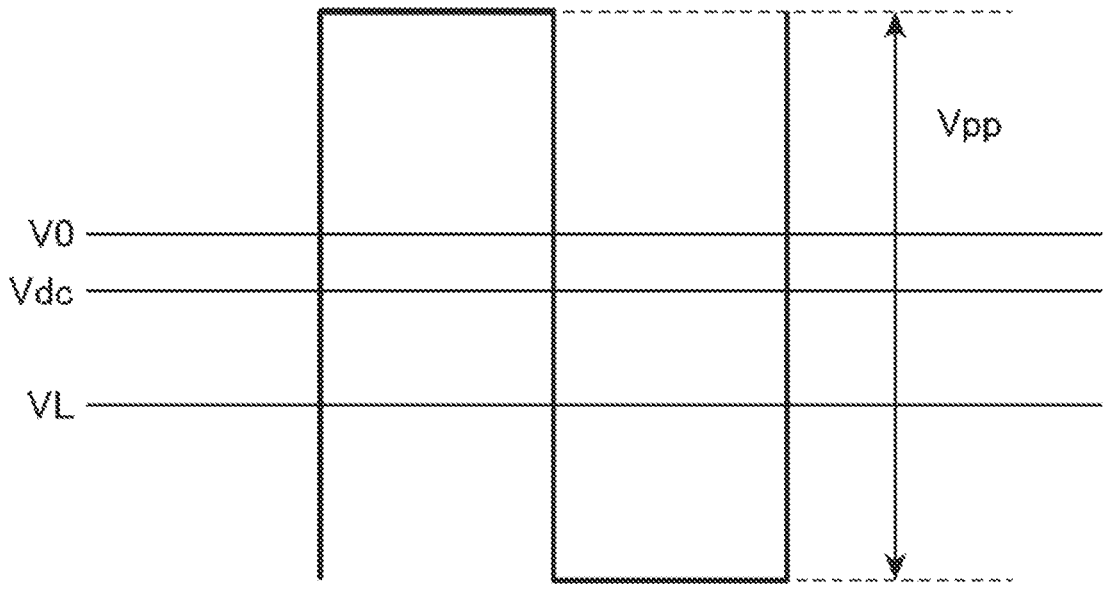
FIG. 3C is a schematic diagram illustrating the relation between the DC bias and the AC bias of the developing bias of the image forming apparatus according to the embodiment of the present disclosure.

FIG. 3A is a schematic diagram of the developing operation of the image forming apparatus 10 according to the present embodiment, and FIG. 3B is a schematic diagram illustrating the magnitude relation between the potentials of the photoconductor drum 20 and the developing roller 231. FIG. 3C is a schematic diagram illustrating the relation between the DC bias and the AC bias of the developing bias. Referring to FIG. 3A, a developing nip section NP is formed between the developing roller 231 and the photoconductor drum 20. Toner TN and carrier CA carried on the developing roller 231 form a magnetic brush. In the developing nip section NP, the toner TN is supplied from the magnetic brush to the photoconductor drum 20 side, and a toner image TI is formed. Referring to FIG. 3B, the surface potential of the photoconductor drum 20 is charged to a background potential V0 (V) by the charging device 21. After that, when the exposure light is irradiated by the exposure device 22, the surface potential of the photoconductor drum 20 changes from the background potential V0 (non-image forming portion) to an image portion potential VL (V) (image forming portion) at the maximum in accordance with the image to be printed. On the other hand, referring to FIG. 3C, a direct current voltage Vdc (DC bias) of the developing bias is applied to the developing roller 231, and an alternating current voltage (alternating current bias) is superimposed on the direct current voltage Vdc. As an example, as illustrated in FIG. 3C, the alternating current bias includes a periodic rectangular wave, and its inter-peak voltage (Vpp) has an amplitude exceeding the background potential V0 and the image portion potential VL of the photoconductor drum 20.

In the case of such a reversal development method, the potential difference between the surface potential V0 and the direct current component Vdc (DC bias) of the developing bias is the potential difference that suppresses the toner fog on the background of the photoconductor drum 20. On the other hand, the potential difference between the surface potential VL after exposure and the direct current component Vdc of the developing bias becomes the developing potential difference that moves the toner of the plus polarity to the image portion of the photoconductor drum 20. Furthermore, the altering current component (AC bias) of the developing bias applied to the developing roller 231 promotes the movement of the toner from the developing roller 231 to the photoconductor drum 20.

<Developing Bias Calibration>

Conventionally, there is known a technique such as above for measuring the image density of a halftone image while changing a DC bias and selecting a DC bias at which a target image density can be obtained from the characteristics. Meanwhile, if the Vpp (inter-peak voltage) of the AC bias is set high, there is a tendency that the image density increases, the texture of the halftone image improves, and the half image pitch unevenness that tends to occur in the rotation cycle of the developing roller 231 is improved. However, if the Vpp is set too high, a leak may occur in the developing nip section NP where the photoconductor drum 20 and the developing roller 231 face each other, and a so-called development ghost worsens, in which the print history one lap before of the developing roller 231 is displayed on the image. In addition, if the Vpp is set too low, an image density change (half image pitch unevenness) will occur on the halftone image according to the circumferential runout of the developing roller 231 and the photoconductor drum 20. For this reason, it was necessary to properly set the Vpp of the AC bias among the developing biases. Furthermore, if the difference between the above-mentioned DC bias Vdc and the background potential V0 of the photoconductor drum 20 becomes too large, the development ghost worsens, while the half image pitch unevenness improves. As described above, the DC bias of the developing bias and the Vpp of the AC bias affect the same image result, and thus it has been difficult to obtain a stable image if only Vpp was adjusted. That is, even if the Vpp of the AC bias is adjusted appropriately, the image defect to be eliminated may worsen depending on the value of the DC bias. Accordingly, the inventor of the present disclosure has newly found a "developing bias calibration" capable of stably respectively setting the DC bias of the developing bias and the inter-peak voltage of the AC bias in the image forming apparatus 10 including the developing device 23 to which the two-component development method is applied.

Figure 4:
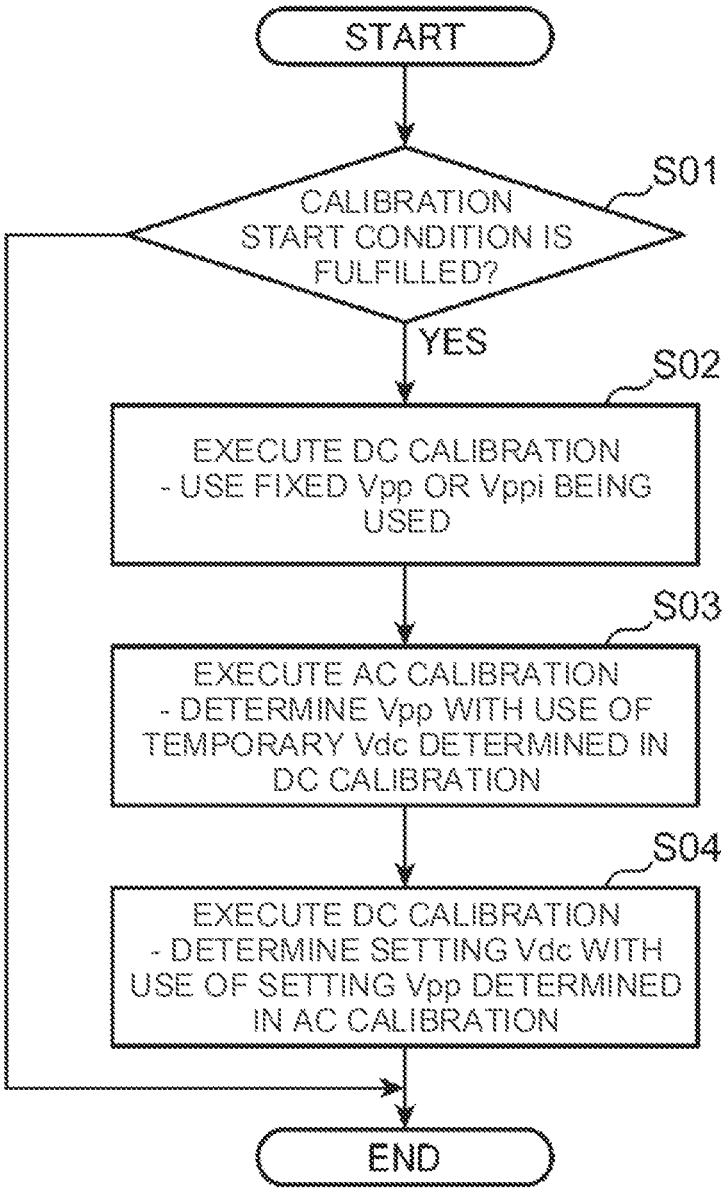
FIG. 4 is a flowchart of the developing bias calibration executed in the image forming apparatus according to the embodiment of the present disclosure.

FIG. 4 is a flowchart of the developing bias calibration executed by the calibration executor 984 in the image forming apparatus 10 according to the present embodiment. The developing bias calibration is executed at the time of non-image formation in which no image is formed on the sheet P.

Specifically, in order to execute the developing bias calibration, the calibration executor 984 determines whether a specific calibration start condition is fulfilled (step S01). As an example, when the number of prints in the image forming apparatus 10 exceeds a specific threshold number, the calibration executor 984 executes the developing bias calibration (YES in step S01). The calibration start condition may be such that the developing bias calibration is executed when the surrounding environment (temperature and humidity) of the image forming apparatus 10 changes significantly. In addition, if the above calibration start condition is not fulfilled, the calibration executor 984 ends the flow without executing the developing bias calibration and waits for the next execution timing.

When the developing bias calibration is started, the calibration executor 984 executes the DC calibration (step S02). The DC calibration is a mode for determining a suitable DC bias (a provisional Vdc, a provisional reference direct current voltage) to be adopted in the AC calibration immediately after. Here, the DC calibration is executed with the use of the fixed Vpp preset and stored in the storage unit 983 or the Vpp (Vppi) used in the immediately preceding image forming operation.

The calibration executor 984 executes the DC calibration, and then the AC calibration (step S03). Here, the AC calibration is executed with the use of the provisional Vdc determined in the above DC calibration. In the AC calibration, an optimum AC bias Vpp (reference inter-peak voltage) at which a desired image density and desired image quality can be obtained in the subsequent image forming operation is determined.

Next, the calibration executor 984 executes the DC calibration again (step S04). In the DC calibration, the Vpp determined in the immediately preceding AC calibration is used, and an optimum DC bias (Vdc) (reference direct current voltage) at which a desired image density and desired image quality can be obtained in the subsequent image forming operation is determined.

In other words, in the present embodiment, a temporary Vdc is determined with the use of a temporary Vpp in the first DC calibration, and a true Vpp that should be originally set is determined from this temporary Vdc in the AC calibration. Then, in the second DC calibration, a true Vdc is determined from the true Vpp. By determining the Vpp and Vdc in two steps in this way, it is possible to obtain images without defects over a long period of time.

In the present embodiment, the calibration executor 984 determines a suitable Vpp on the basis of the developing current detected by the ammeter 973, meanwhile determines a suitable Vdc on the basis of the image density detected by the density sensor 100 (optical sensor). This is because the stable saturation density of the image has been selected as the condition for determining the Vpp, and the level (magnitude) of the saturation density has been selected as the condition for determining the Vdc. With this selection method, the image quality can be made more stable.

In a case where the condition for determining the Vpp is that the saturation density of the image is stable, it is difficult to accurately measure the image density in the saturation area with the density sensor 100 including an optical sensor, and it has been necessary to measure the saturation of the image by a method other than image density. Accordingly, the inventor of the present disclosure has newly found a method for determining the Vpp on the basis of the developing current. Each of the above DC calibration and AC calibration will be described in detail below.

<DC Calibration>

Figure 5:
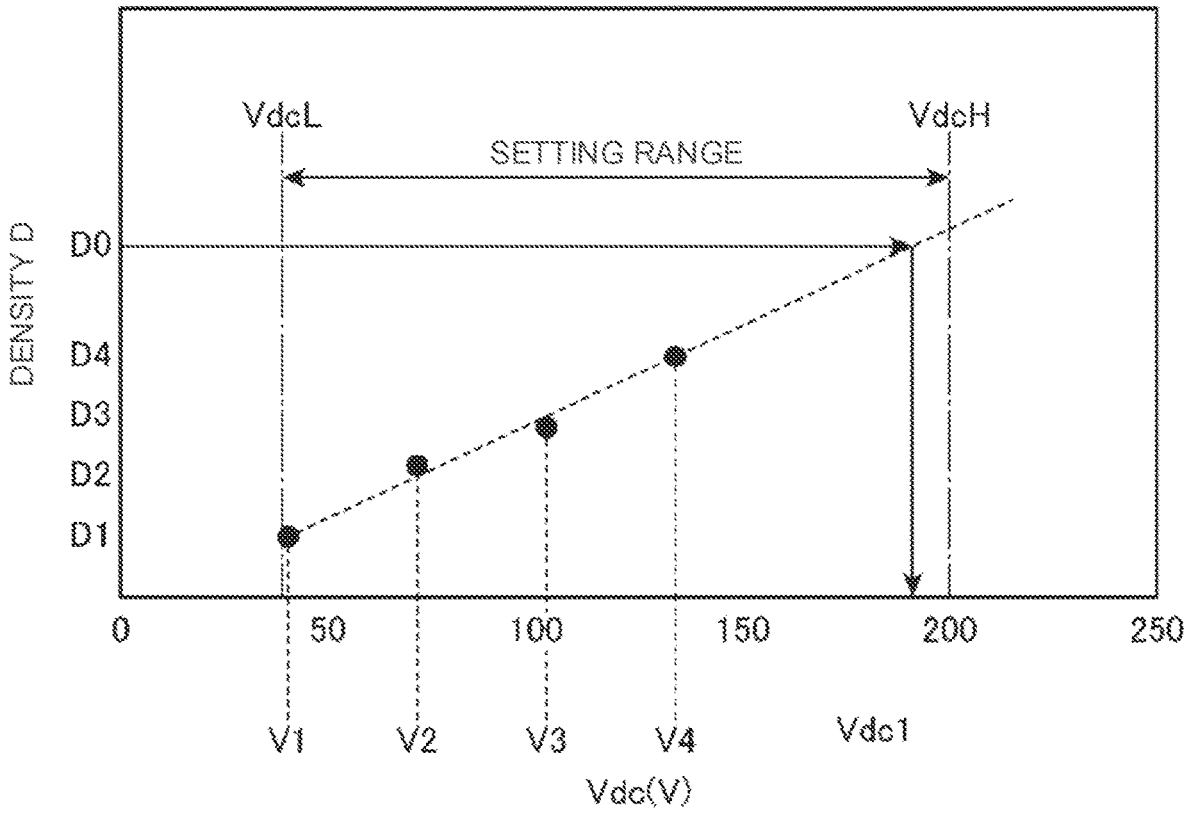
FIG. 5 is a graph illustrating the relation between the DC bias and the image density for explaining the DC calibration executed in the image forming apparatus according to the embodiment of the present disclosure.

FIG. 5 is a graph indicating the relation between the DC bias Vdc and an image density D for explaining the DC calibration executed in the image forming apparatus 10 according to the present embodiment. When starting the DC calibration (steps S02 and S04 in FIG. 4), the calibration executor 984 sets the surface potential of the photoconductor drum 20 to a VL, and then changes the DC bias (Vdc) of the developing bias in the order of V1, V2, V3, and V4, forms a toner image for measurement corresponding to each DC bias on the photoconductor drum 20, and transfers the toner image for measurement to the intermediate transfer belt 141. Then, the density of each toner image for measurement is detected by the density sensor 100. Each image density (may be the reflection density detected by the density sensor 100 or the output voltage of the density sensor 100) at this time is defined as D1, D2, D3, and D4. Then, as illustrated in FIG. 5, the relation between the Vdc and image density D is created as a primary approximate expression with the above DC bias Vdc as the horizontal axis and the image density as the vertical axis. On the basis of this approximate expression, a Vdc (a Vdc1, a provisional reference direct current voltage, a reference direct current voltage) at which a desired target image density D0 can be obtained at the time of image formation is determined. If the Vdc1 obtained at this time is less than the preset lower limit value of the Vdc (VdcL: for example, 40 V), the Vdc1 is replaced as Vdc1=VdcL. Similarly, if the Vdc1 exceeds the preset upper limit value of the Vdc (VdcH: for example, 200 V), Vdc1 is replaced as Vdc1=VdcH. As described above, in the DC calibration executed in step S02 in FIG. 4, the DC calibration is executed with the use of the fixed Vpp stored in advance in the storage unit 983 or the Vpp (Vppi) used in the immediately preceding image forming operation. On the other hand, in the DC calibration executed in step S04 in FIG. 4, the Vpp determined in the immediately preceding AC calibration (step S02 in FIG. 4) is used. For other AC bias parameters, the same values as when forming the image are used. The Vdc1 determined as above is used as the provisional reference direct current voltage or the reference direct current voltage. The graph in FIG. 5 may be drawn with the horizontal axis as ΔV (Vdc−VL).

<Change in Toner Adhesion Amount and Change in Developing Current>

When the toner charge amount in the developing device 23 changes, or when the developing gap changes due to the runout of the developing roller 231 or the like, both the above DC bias and AC bias have the property that the moving force F (=a toner charge amount Q×an electric field magnitude E) applied to the toner changes and the image density fluctuates. However, strictly speaking, the DC bias and AC bias have different characteristics. In the case of the AC bias, increasing the Vpp (inter-peak voltage) increases the image density, but eventually the increase in the image density almost disappears, and when the Vpp is further increased, the image density decreases conversely. On the other hand, when the developing potential difference (Vdc−VL) in the DC bias is increased, the image density continues to increase, and the amount of increase in the image density eventually decreases, but the decrease in the image density as in the AC bias has not been confirmed. It is presumed that this is because the AC electric field forms a bidirectional electric field (reciprocating electric field) between the photoconductor drum 20 and the developing roller 231 in the developing nip section, whereas the DC electric field forms a unidirectional electric field.

More specifically, the reciprocating electric field of the AC bias consists of two electric fields in opposite directions, that is, the developing electric field that supplies the toner from the developing roller 231 to the photoconductor drum 20 and the recovering electric field that recovers the toner from the photoconductor drum 20 to the developing roller 231. Then, when the Vpp is increased, both electric fields increase, but eventually the amount of toner supplied by the developing electric field becomes maximum. After that, when the Vpp is further increased, the amount of toner recovered is increased due to the rise of the recovering electric field, but the amount of toner supplied by the developing electric field is already the maximum. As a result, the final developing amount of the toner decreases as the Vpp increases, depending on the magnitude relation between the supply and recovery of the toner between the photoconductor drum 20 and the developing roller 231.

<Relation Between Vpp and Developing Current>

As described above, while the relation between the DC bias and AC bias and the developing amount of the toner can be grasped, when the Vpp of the AC bias is increased, it has not been fully known how the developing current flowing between the developing roller 231 and the developing bias applicator 971 behaves.

It is presumed that the cause of this is because the developing current generated in the developing nip section NP includes a "toner moving current flowing due to the movement of toner", a "magnetic brush current flowing through the magnetic brush of the developer in the image portion (the image portion magnetic brush current)", and a "magnetic brush current flowing through the magnetic brush of the developer in the non-image portion (the non-image portion magnetic brush current)". This is because the toner moving current changes in accordance with the amount of movement of the toner, and thus if the Vpp is increased, the toner moving current will increase and then decrease, but the image portion magnetic brush current is the current flowing through the magnetic brush in the developing nip section NP, and thus tends to increase as the Vpp increases. Furthermore, in a non-image forming area existing at both ends in the longitudinal direction of an image forming area, the non-image portion magnetic brush current tends to increase the current in the opposite direction as the Vpp increases. Therefore, it has not been fully known how the developing current that is complicatedly affected by the behavior of the total current of the toner moving current, image portion magnetic brush current, and non-image portion magnetic brush current behaves as the Vpp increases.

Accordingly, the present inventor has diligently conducted an experiment to confirm the behavior of the developing current when the Vpp of the AC bias of the developing bias is increased, and has newly discovered that there are multiple patterns in this tendency. That is, it has been clarified that when the Vpp of the AC bias is increased, there are a pattern in which the developing current (direct current) increases but eventually reaches a change point where the gradient thereof changes and the developing current still gradually increases thereafter, and a pattern in which the developing current conversely decreases from the above-mentioned change point.

The present inventor has newly focused on setting the Vpp of the AC bias to an area where the change in image density is small, on the basis of such a pattern of the developing current. As a result, it has become possible to reduce the change in image density even if the toner charge amount or developing gap changes. The details of the AC calibration for setting such Vpp are described below.

<AC Calibration>

Figure 6:
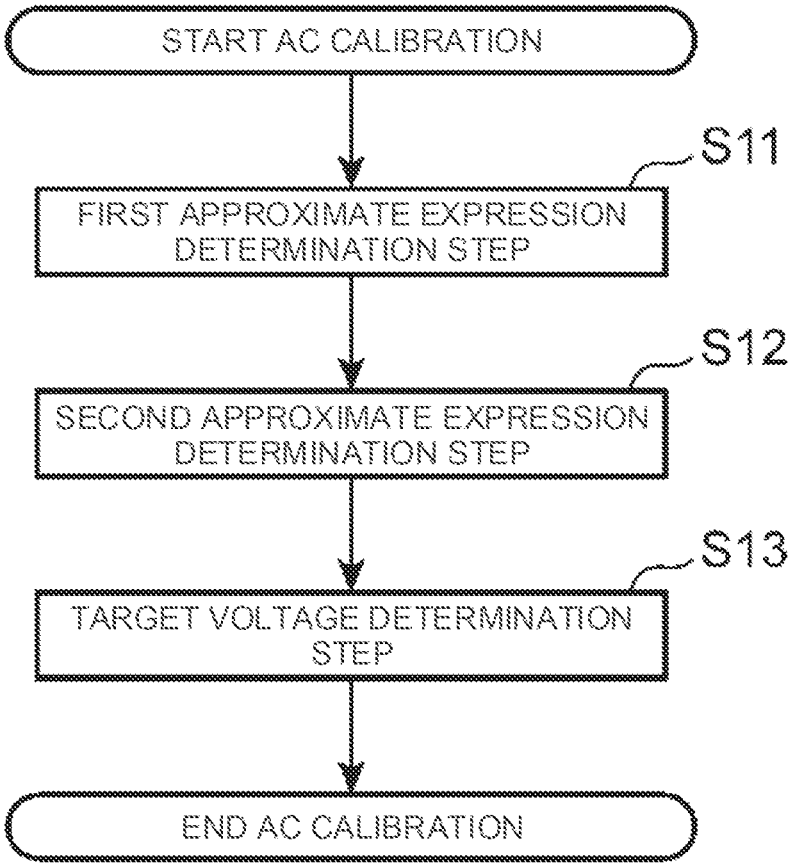
FIG. 6 is a flowchart of the AC calibration executed in the image forming apparatus according to the embodiment of the present disclosure.
Figure 7:
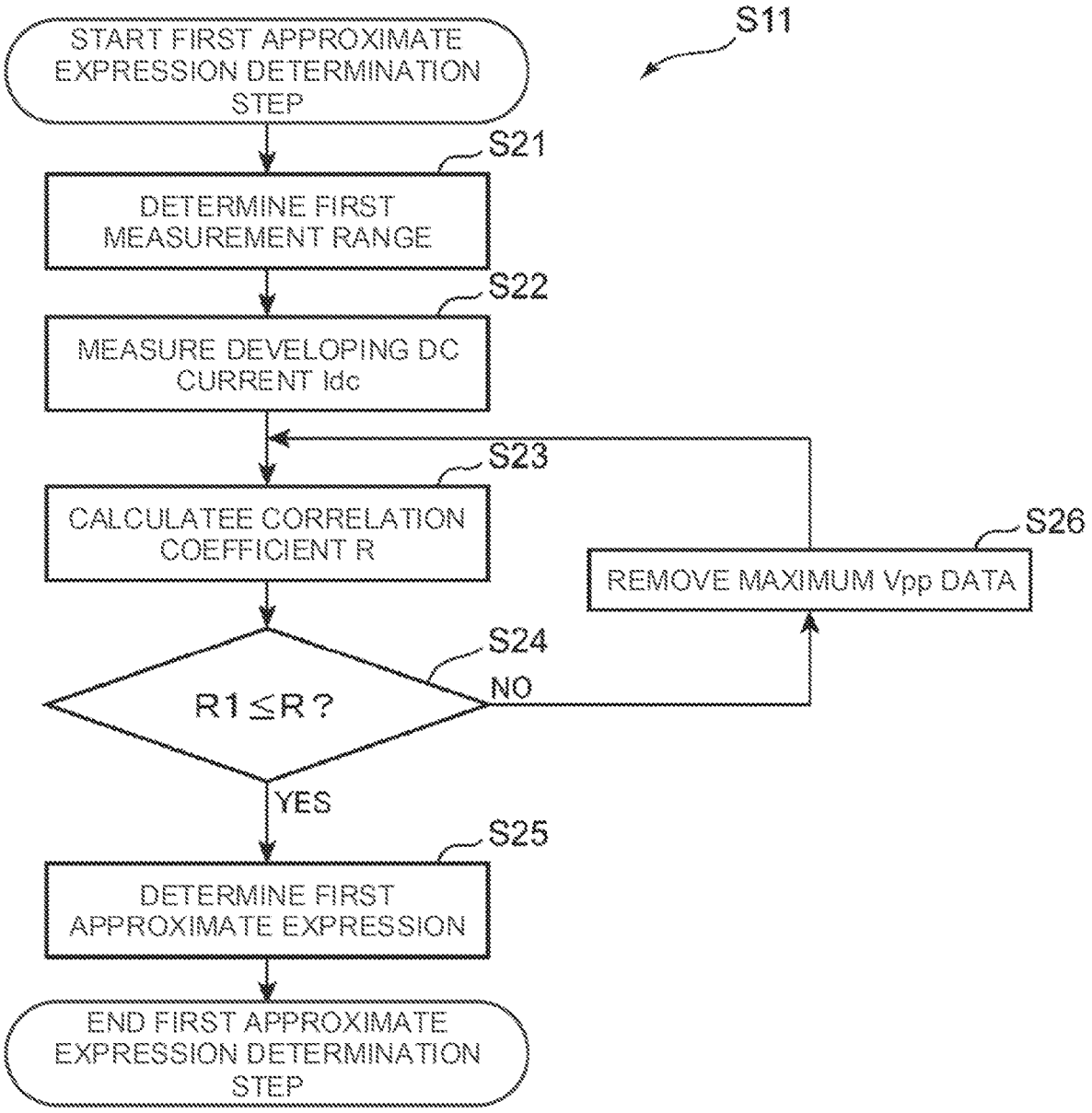
FIG. 7 is a flowchart of the first approximate expression determination step of the AC calibration executed in the image forming apparatus according to the embodiment of the present disclosure.
Figure 8:
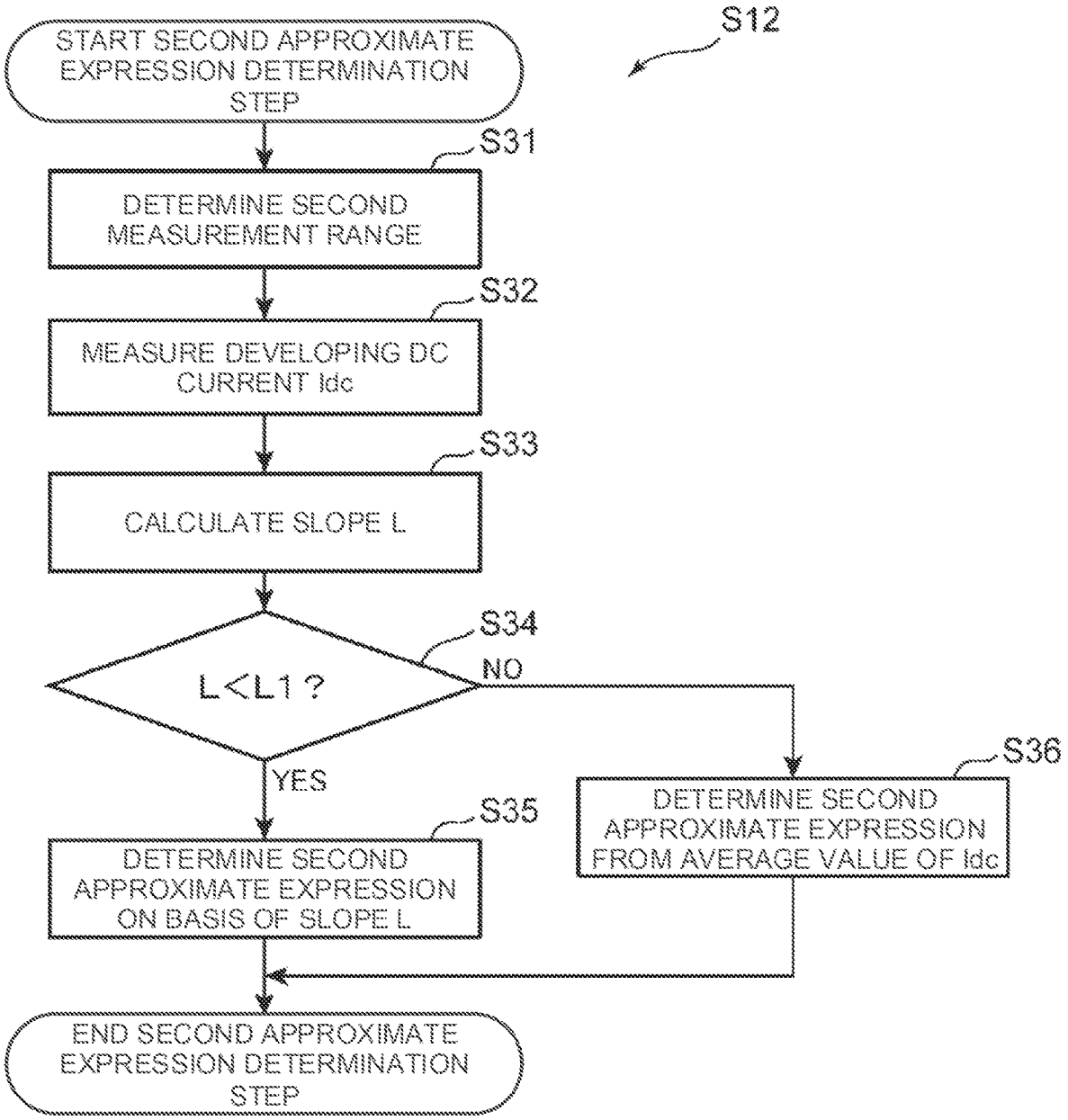
FIG. 8 is a flowchart of the second approximate expression determination step of the AC calibration executed in the image forming apparatus according to the embodiment of the present disclosure.

FIG. 6 is a flowchart of the AC calibration executed in the image forming apparatus 10 according to the present embodiment. FIG. 7 is a flowchart of the first approximate expression determination step (first approximate expression determination operation) of the AC calibration executed in the image forming apparatus 10 according to the present embodiment. FIG. 8 is a flowchart of the second approximate expression determination step (second approximate expression determination operation) of the AC calibration executed in the image forming apparatus 10 according to the present embodiment.

In the present embodiment, the calibration executor 984 executes the AC calibration in the step S02 of FIG. 4. The AC calibration is a mode for determining the reference inter-peak voltage (target voltage) that is the reference for the inter-peak voltage (Vpp) of the alternating current voltage of the developing bias applied to the developing roller 231 in the image forming operation.

When the AC calibration is started, the calibration executor 984 executes the first approximate expression determination step (step S11 in FIG. 6), the second approximate expression determination step (step S12 in FIG. 6), and a target voltage determination step (step S13 in FIG. 6) in order.

The first approximate expression determination step is described in detail with reference to FIG. 7. When the first approximate expression determination step is started, the calibration executor 984 acquires the information regarding the first measurement range stored in the storage unit 983. The first measurement range is information regarding the range and interval of the Vpp of the alternating current bias applied to the developing roller 231 in the first approximate expression determination step. In the present embodiment, as an example, information regarding four inter-peak voltages for first measurement is acquired by the calibration executor 984. As a result, the first measurement range in the first approximate expression determination step is determined (step S21).

Next, the calibration executor 984 forms a latent image for measurement including a solid image on the photoconductor drum 20, and applies a developing bias to the developing roller 231 to develop the latent image for measurement into a toner image for measurement. Specifically, the photoconductor drum 20 is rotated and the peripheral surface of the photoconductor drum 20 is uniformly charged to 250 V by the charging device 21 as in the case of image formation. As an example, the charging range of the photoconductor drum 20 in the axial direction (width direction) is set to 322 mm. Then, the potential of a part of the photoconductor drum 20 is lowered to 10 V by the exposure light emitted from the exposure device 22, and a latent image for measurement is formed on the photoconductor drum 20. In the present embodiment, the width of the latent image for measurement is set to 287 mm and the width of the magnetic brush of the developing roller is set to 304 mm with respect to the sheet width of 297 mm (A4 width), and the difference between the width of the magnetic brush and the width of the latent image for measurement is the area where the non-image portion magnetic brush current flows.

Meanwhile, on the developing roller 231, an alternating current bias with a frequency of 10 kHz and a duty of 50% is superimposed on a direct current voltage of 150 V. The Vpp of the alternating current bias is set in order to the above-mentioned four inter-peak voltages for first measurement. As a result, for each of the inter-peak voltages for first measurement, when the above-mentioned latent image for measurement is developed into a toner image for measurement by the developing roller 231, the ammeter 973 measures each direct current component (direct current Idc) of the developing current flowing between the developing roller 231 and the developing bias applicator 971 (step S22). As a result, four developing currents corresponding to the four inter-peak voltages for first measurement are obtained, and four sets of data regarding the inter-peak voltages for first measurement and the developing current are obtained. It is desirable that the developing current is calculated with an average current of one lap or more for the rotation of the developing roller 231, and it is more desirable to average the rotation of an integral multiple of one lap.

Next, the calibration executor 984 regresses the relation between the above four inter-peak voltages for first measurement and the four developing currents by a primary expression, and calculates a correlation coefficient R thereof (step S23). As an example, the calibration executor 984 calculates the primary expression by a least-squares method and obtains the correlation coefficient R.

Next, the calibration executor 984 compares the magnitude relation between the correlation coefficient R obtained above and a threshold value R1 stored in advance in the storage unit 983 (step S24). As an example, the threshold value R1 is set to 0.90. Here, if the threshold value R1 the correlation coefficient R (YES in step S24), the calibration executor 984 determines the primary expression regressed above as a first approximate expression (step S25). On the other hand, if the threshold value R1>the correlation coefficient R in step S24 (NO in step S24), the calibration executor 984 removes the largest Vpp data among the above four sets of data and recalculates the correlation coefficient R on the basis of the remaining three pieces of data. After that, the calibration executor 984 executes steps S24 and S25 in the same manner as above. If the relation of the threshold value R1 the correlation coefficient R is not fulfilled even after removing the maximum Vpp data in step S26, the calibration executor 984 may further remove some data and repeat the step, or may interrupt the execution of the AC calibration and use the result of the previous AC calibration.

When the first approximate expression determination step is completed as described above, the second approximate expression determination step is started. The second approximate expression determination step is described in detail with reference to FIG. 8. When the second approximate expression determination step is started, the calibration executor 984 acquires the information regarding the second measurement range stored in the storage unit 983. The second measurement range is information regarding the range and interval of the alternating current bias Vpp applied to the developing roller 231 in the second approximate expression determination step. In the present embodiment, as an example, information regarding three inter-peak voltages for second measurement is acquired by the calibration executor 984. As a result, the second measurement range in the second approximate expression determination step is determined (step S31). The minimum value of the second measurement range (three inter-peak voltage for second measurement) is set larger than the maximum value of the first measurement range (four inter-peak voltages for first measurement).

Next, as is the case with step S12 in FIG. 7, the calibration executor 984 forms a latent image for measurement on the photoconductor drum 20, and applies a developing bias to the developing roller 231 to develop the latent image for measurement into a toner image for measurement. In doing so, on the developing roller 231, an AC bias with a frequency of 10 kHz and a duty of 50% is superimposed on a direct current voltage of 150 V, and the Vpp of the alternating current bias is set to the above-mentioned three inter-peak voltage for second measurement in order. As a result, for each of the inter-peak voltages for second measurement, when the above-mentioned latent image for measurement is developed by the developing roller 231, the ammeter 973 measures the direct current component (direct current Idc) of the developing current flowing between the developing roller 231 and the developing bias applicator 971 (step S32). As a result, three developing currents corresponding to the three inter-peak voltages for second measurement are obtained, and three sets of data regarding the inter-peak voltages for second measurement and the developing current are obtained.

Next, the calibration executor 984 regresses the relation between the above three inter-peak voltages for second measurement and the three developing currents by a primary expression (approximate expression for first determination), and calculates a slope L thereof (step S33). As an example, the calibration executor 984 calculates the primary expression by a least-squares method and obtains the slope L.

Next, the calibration executor 984 compares the magnitude relation between the correlation slope L obtained above and a threshold value L1 stored in advance in the storage unit 983 (step S34). As an example, the threshold value L1 is set to 0 (zero). Here, if the slope L<the threshold value L1 (YES in step S34), the calibration executor 984 determines the primary expression regressed above as a second approximate expression (step S35). On the other hand, if the slope L≥the threshold value L1 in the step S34 (NO in step S34), the calibration executor 984 calculates the average value of the Vpp of the above three sets of data, and sets, as the second approximate expression, a linear expression in which the average value is constant with respect to the change in the inter-peak voltage (step S36).

When the first approximate expression determination step and the second approximate expression determination step illustrated in FIGS. 7 and 8 are respectively completed, the calibration executor 984 executes the target voltage determination step (step S13 in FIG. 6). In the target voltage determination step, the calibration executor 984 determines, as the reference inter-peak voltage (target voltage VT), the inter-peak voltage at the intersection where the first approximate expression and the second approximate expression intersect each other. As a result, the inter-peak voltage during the image forming operation can be set near the boundary (near the peak) of the relation between the inter-peak voltage and the developing current in each of the first measurement range and the second measurement range. In the present embodiment, an inter-peak voltage obtained by multiplying the reference inter-peak voltage determined as described above by 1.2, including a specific safety factor, is applied as the actual inter-peak voltage during the image forming operation.

Figure 9:
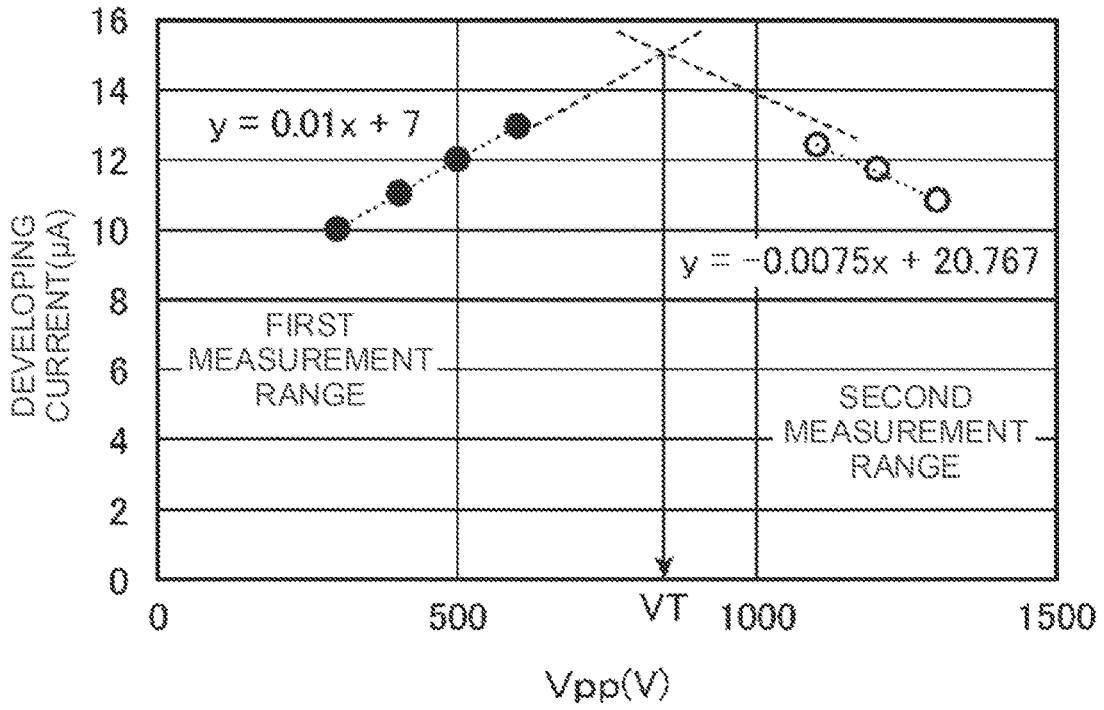
FIG. 9 is a graph illustrating the relation between the Vpp of the AC calibration executed in the image forming apparatus according to the embodiment of the present disclosure and the developing current.
Figure 10:
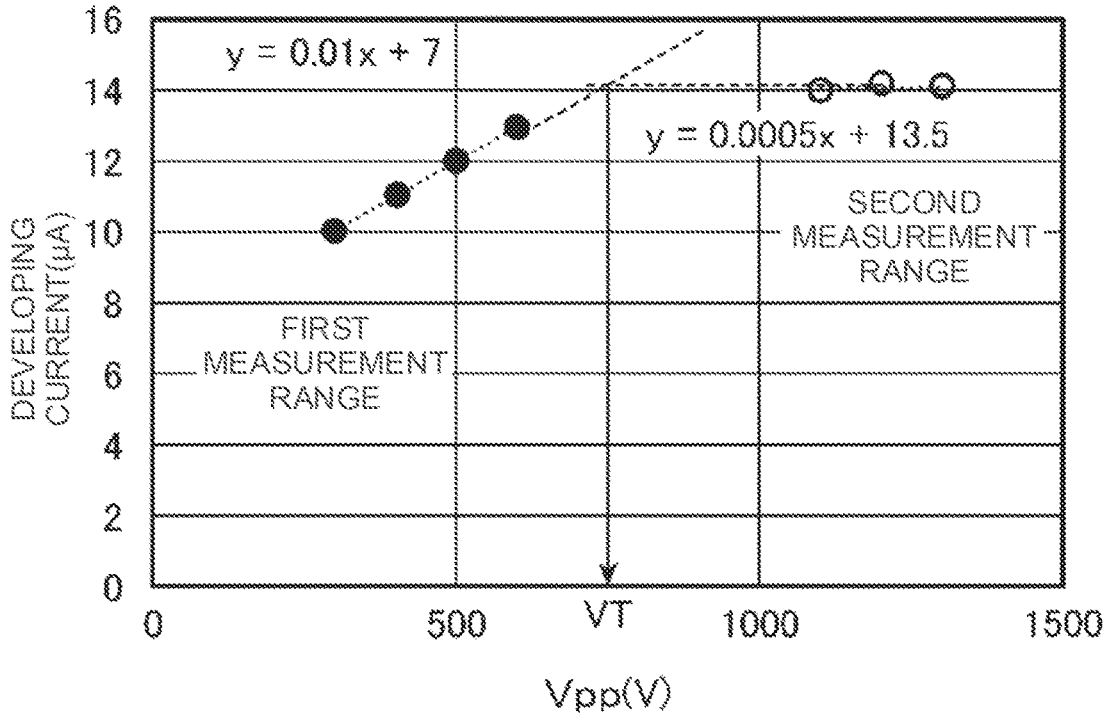
FIG. 10 is a graph illustrating the relation between the Vpp of the AC calibration executed in the image forming apparatus according to the embodiment of the present disclosure and the developing current.
Figure 11:
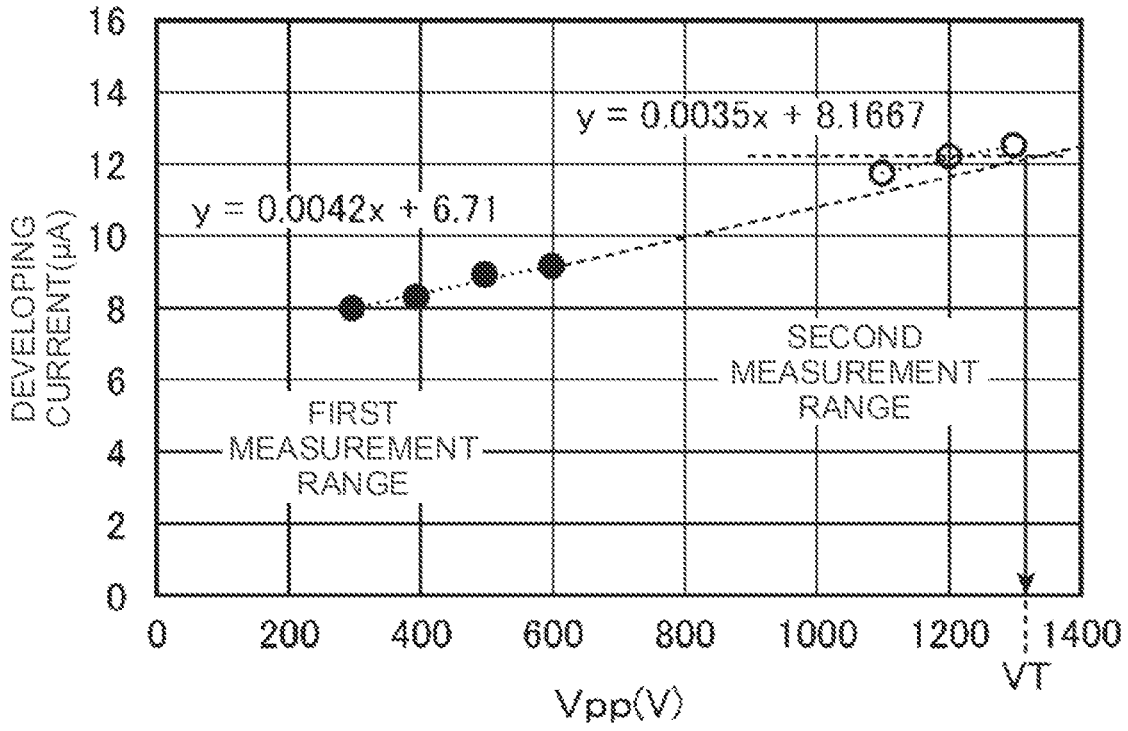
FIG. 11 is a graph illustrating the relation between the Vpp of the AC calibration executed in the image forming apparatus according to the embodiment of the present disclosure and the developing current.

FIGS. 9, 10, and 11 are respectively a graph illustrating the relation between the Vpp of the AC calibration executed in the image forming apparatus 10 according to the present embodiment and the developing current. In each figure, the developing current is illustrated on the vertical axis (Y axis) and the Vpp is illustrated on the horizontal axis (X axis).

Tables 1 and 2 indicate the relation between the Vpp and the developing current in the first and second measurement ranges illustrated in FIG. 9.

TABLE 1

| First Measurement Range | |
|---|---|
| Measured Voltage Vpp(V) | Developing Current (μA) |
| 300 | 10 |
| 400 | 11 |
| 500 | 12 |
| 600 | 13 |

TABLE 2

| Second Measurement Range | |
|---|---|
| Measured Voltage Vpp(V) | Developing Current (μA) |
| 1100 | 14 |
| 1200 | 14.2 |
| 1300 | 14.1 |

In FIG. 9, the primary expression of y=0.01x+7 is calculated as the first approximate expression in the first approximate expression determination step illustrated in FIG. 7. Meanwhile, in the second approximate expression determination step illustrated in FIG. 8, since the slope L is minus (L<L1=0), the primary expression of y=−0.0075x+20.767 is calculated as the second approximate expression in step S35. As a result, in the target voltage determination step S13, Vpp=target voltage VT=787 V is calculated as the intersection of the first approximate expression and the second approximate expression, and 1.2 is set as the safety factor, and thus Vpp=787×1.2=944 (V) is selected during the image forming operation.

Tables 3 and 4 indicate the relation between the Vpp and the developing current in the first and second measurement ranges illustrated in FIG. 10.

TABLE 3

| First Measurement Range | |
|---|---|
| Measured Voltage Vpp(V) | Developing Current (μA) |
| 300 | 10 |
| 400 | 11 |
| 500 | 12 |
| 600 | 13 |

TABLE 4

| Second Measurement Range | |
|---|---|
| Measured Voltage Vpp(V) | Developing Current (μA) |
| 1100 | 12.5 |
| 1200 | 11.8 |
| 1300 | 11 |

In FIG. 10, the primary expression of y=0.01x+7 is calculated as the first approximate expression in the first approximate expression determination step illustrated in FIG. 7. Meanwhile, in the second approximate expression determination step illustrated in FIG. 8, since the slope L is plus (L L1=0), the average value of the developing current is calculated in step S36, and the primary expression of y=14.1 is calculated as the second approximate expression. As a result, in the target voltage determination step S13, Vpp=target voltage VT=710 V is calculated as the intersection of the first approximate expression and the second approximate expression, and 1.2 is set as the safety factor, and thus Vpp=710×1.2=852 (V) is selected during the image forming operation.

Tables 5 and 6 indicate the relation between the Vpp and the developing current in the first and second measurement ranges illustrated in FIG. 11.

TABLE 5

| First Measurement Range | |
|---|---|
| Measured Voltage Vpp(V) | Developing Current (μA) |
| 300 | 8 |
| 400 | 8.3 |
| 500 | 8.9 |
| 600 | 9.2 |

TABLE 6

| Second Measurement Range | |
|---|---|
| Measured Voltage Vpp(V) | Developing Current (μA) |
| 1100 | 12 |
| 1200 | 12.4 |
| 1300 | 12.7 |

In FIG. 11, the primary expression of y=0.0042x+6.71 is calculated as the first approximate expression in the first approximate expression determination step illustrated in FIG. 7. Meanwhile, in the second approximate expression determination step illustrated in FIG. 8, since the slope L is plus (L L1=0), the average value of the developing current is calculated in step S36, and the primary expression of y=12.4 is calculated as the second approximate expression. As a result, in the target voltage determination step S13, Vpp=target voltage VT=1310 V is calculated as the intersection of the first approximate expression and the second approximate expression, and 1.2 is set as the safety factor, and thus Vpp=1310×1.2=1572 (V) is selected during the image forming operation.

<Reason why the Developing Current (DC Component) has a Peak (Change Point)>

Next, as in each of the above data, the reason why the developing current (DC component) has a peak (change point) with respect to the Vpp is presumed. As described above, the developing current includes the "toner moving current+image portion magnetic brush current+non-image portion magnetic brush current". However, when the developing current is obtained, in the portion of the electrostatic latent image corresponding to the image portion (solid image portion), both of this "toner moving current+image portion magnetic brush current" flow, but in the white background portion at the end in the width direction, only the "non-image portion magnetic brush current" flows in the direction opposite to the image portion. Therefore, as the Vpp is increased, the non-image portion magnetic brush current of this white background portion increases, and the total developing current decreases.

The image portion magnetic brush current also increases as the Vpp increases, but the toner layer formed by the toner adhering to the surface of the photoconductor drum 20 becomes a resistance layer, and an extreme increase in the image portion magnetic brush current is suppressed. On the other hand, in the white background portion, some toner moves to the sleeve surface of the developing roller 231 but the amount is overwhelmingly smaller than that of the image portion, and thus the toner layer adhering to the sleeve surface does not have a high resistance as compared with the image portion. As a result, the non-image portion magnetic brush current in the white background portion increases significantly with the increase in the Vpp, and this magnetic brush current flows in the direction opposite to the toner moving current. Thus, it is presumed that the developing current will have a change point (peak).

The present inventor has newly found the above relation between the developing current and the Vpp through repeated diligent experiments. In addition, the present inventor has further found that this phenomenon is more likely to occur as the resistance of the carrier is lower, and that when 0.2 g of the carrier is filled between parallel flat plates (area 240 $mm^2$) with a gap of 1 mm and the resistance value of the carrier is obtained on the basis of the current flowing when a voltage of 1000 V is applied, this phenomenon appears prominently at $10^9$ ohms or below.

That is, if a two-component developer is interposed between the photoconductor drum 20 and the developing roller 231 and a latent image for measurement is formed at the central portion in the axial direction (width direction) of the electrostatic latent image, and when a white background portion is arranged at both ends thereof, the above-mentioned change point occurs at the boundary between the first measurement range and the second measurement range in the present embodiment. In particular, the phenomenon that the slope of the second approximate expression is distributed over a wide range positive and negative is due to the current flowing at both ends in the axial direction of the developing roller 231 such as that described above in the direction opposite to the central portion. In particular, in the present embodiment, in the axial direction, the range of the magnetic brush on the developing roller 231 is narrower than the charging range on the photoconductor drum 20, and the range of the image portion (solid image portion) in the latent image for measurement formed on the photoconductor drum 20 is further narrower than the range of the magnetic brush. As a result, as described above, an area is formed at both ends of the developing roller 231 in the axial direction, in which the current in the direction opposite to the current of the image portion flows in the magnetic brush. In addition, such a phenomenon is peculiar to the developing nip section, which cannot occur in the discharge current generated between, for example, the photoconductor drum 20 and a charging roller in contact with the peripheral surface thereof, and has been found by repeated experiments such as that described above. In particular, since there is no developer intervening between the charging roller and the photoconductor drum 20, which causes fluctuations in the resistance of the carrier, it is unlikely that the current will eventually decrease as the inter-peak voltage is increased.

As described above, in the present embodiment, the calibration executor 984 executes the developing bias calibration (bias condition determination mode) when a specific execution condition is fulfilled. The developing bias calibration includes a first DC calibration (first direct current voltage determination mode), an AC calibration executed after the first DC calibration (inter-peak voltage determination mode), and a second DC calibration executed after the AC calibration (second direct current voltage determination mode).

In the first DC calibration, the calibration executor 984 determines a provisional reference direct current voltage that is a provisional reference for the direct current voltage of the developing bias applied to the developing roller 231, on the basis of the density of the toner image for measurement, detected by the density sensor 100. In addition, in the AC calibration, the calibration executor 984 determines a reference inter-peak voltage that is a reference for the inter-peak voltage of the alternating current voltage of the developing bias applied to the developing roller 231 in the image forming operation, on the basis of the direct current component of the developing current detected by the ammeter 973 when the developing bias including the provisional reference direct current voltage is applied to the developing roller 231 to develop with toner the latent image for measurement into the toner image for measurement. Furthermore, in the second DC calibration, the calibration executor 984 determines a reference direct current voltage that is a reference for the direct current voltage of the developing bias applied to the developing roller 231 in the image forming operation, on the basis of the density of the toner image for measurement, detected by the density sensor 100 when the developing bias including the reference inter-peak voltage is applied to the developing roller 231 to develop with toner the latent image for measurement into the toner image for measurement.

More specifically, in each DC calibration, the calibration executor 984 forms a plurality of toner images for measurement on the photoconductor drum 20 while controlling the photoconductor drum 20, the charging device 21, the exposure device 22, and the developing device 23. Then, the calibration executor 984 applies a developing bias to the developing roller 231 corresponding to a specific latent image for measurement formed on the photoconductor drum 20 to develop with toner the latent image for measurement into the toner image for measurement, and then transfers same to the photoconductor drum 20 and the intermediate transfer belt 141. After that, the calibration executor 984 determines a reference direct current voltage that is a reference for the direct current voltage of the developing bias applied to the developing roller 231 in the image forming operation, on the basis of the density of the toner image for measurement on the intermediate transfer belt 141, detected by the density sensor 100.

Furthermore, in the first DC calibration, the calibration executor 984 determines the provisional reference direct current voltage that is the provisional reference of the direct current voltage of the developing bias referred to in the subsequent AC calibration. In the AC calibration after the first DC calibration is performed, the above provisional reference direct current voltage may be used as it is, or the provisional reference direct current voltage multiplied by a specific safety factor may be used. In addition, in the image forming operation after the second DC calibration is performed, the above reference direct current voltage may be used as it is, or the reference direct current voltage multiplied by a specific safety factor may be used.

According to such a configuration, even if each image forming condition such as the distance (DS gap) between the developing roller 231 and the photoconductor drum 20, the toner charge amount, and the resistance of the carrier changes, the calibration executor 984 executes the developing bias calibration as needed, and it is thereby possible to set the DC bias and AC bias (Vpp) according to each image forming condition. As a result, it is possible to respectively stably set the DC bias of the developing bias and the inter-peak voltage of the AC bias that affect the same image defect, and to stabilize and improve the image quality.

In addition, in the present embodiment, in the AC calibration (inter-peak voltage determination mode), in each of the first measurement range and the second measurement range, the reference inter-peak voltage is set from the intersection of the first approximate expression and the second approximate expression, which represent the relation between the inter-peak voltage of the alternating current bias and the developing current. In the vicinity of the above intersection, there is a change point in the relation between the inter-peak voltage of the alternating current bias and the developing current, and thus the developing current is not easily affected by the slope of the first approximate expression in the first measurement range, and it is possible to prevent the image density from changing due to fluctuations in the toner charge amount and the developing gap. In addition, setting the reference inter-peak voltage is suppressed in an area where the slope of the second approximate expression becomes smaller than a specific threshold value in accordance with the fluctuation of the carrier resistance and the developing current tends to decrease as the inter-peak voltage increases. As a result, it is possible to set the alternating current bias of the developing bias at which a stable image density can be output in the image forming operation. For the actual inter-peak voltage during the image forming operation, the value of the reference inter-peak voltage as it is, a value obtained by multiplying the reference inter-peak voltage by a certain ratio, a value obtained by adding a certain value to the reference inter-peak voltage, a value obtained by multiplying the reference inter-peak voltage by a certain ratio and then adding a certain value, a value obtained by increasing the multiplication factor (for example, 1 or more) to improve pitch unevenness when the reference inter-peak voltage is low, or a value obtained by decreasing the multiplication factor (for example, less than 1) to suppress the occurrence of leaks may be used. In addition, the upper and lower limits of the actual inter-peak voltage during the image forming operation may be determined on the basis of an initially set inter-peak voltage (initial setting value). At the time of initial setting, the characteristics are the most stable because of not being significantly affected by environmental factors, usage history, and the like. Therefore, it is desirable to set the upper and lower limits of the actual inter-peak voltage in advance on the basis of the initial setting value in such a manner that the voltage does not become a voltage at which problems such as pitch unevenness and leak may occur in the future.

In addition, in the present embodiment, the calibration executor 984 determines the first approximate expression by a least-squares method from the direct current component of the developing current each obtained at the at least three inter-peak voltages for first measurement included in the first measurement range. According to this configuration, the first approximate expression can be determined from the inter-peak voltages for first measurement included in the first measurement range by a simple arithmetic process.

In addition, in the present embodiment, if a slope of an approximate expression for first determination, that is a primary approximate expression determined by a least-squares method from the direct current component of the developing current each obtained at the at least three inter-peak voltages for second measurement included in the second measurement range is greater than a preset first threshold value L1, the calibration executor 984 sets, as the second approximate expression, a linear expression in which an average value of the direct current component of the developing current each obtained at the at least three inter-peak voltages for second measurement is constant with respect to a change in the inter-peak voltage, and if the slope of the approximate expression for first determination is smaller than the first threshold value L1, the calibration executor 984 sets the approximate expression for first determination as the second approximate expression. According to this configuration, in the process for determining the second approximate expression whose slope is likely to change due to the influence of the resistance value of the carrier, a more appropriate approximate expression can be selected as the second approximate expression in accordance with the slope of the approximate expression for first determination.

In addition, in the present embodiment, an interval between a plurality of the inter-peak voltages for first measurement in the first measurement range and an interval between a plurality of the inter-peak voltages for second measurement in the second measurement range are respectively set to be smaller than an interval between the maximum value in the first measurement range and the minimum value in the second measurement range. According to this configuration, the first measurement range and the second measurement range are clearly distinguished, and the interval of inter-peak voltages is finely set in each measurement range, and the accuracy of determining the first approximate expression and the second approximate expression thereby can be improved.

In the first approximate expression determination operation, if a correlation coefficient of the first approximate expression is smaller than a preset second threshold value, the bias condition determiner determines the first approximate expression on the basis of the direct current component of the developing current corresponding to a remaining inter-peak voltage obtained by excluding at least one inter-peak voltage from the at least three inter-peak voltages for first measurement. According to this configuration, if the correlation coefficient is small in the process for determining the first approximate expression, it is possible to determine the first approximate expression with higher accuracy by excluding the data of at least one inter-peak voltage.

In particular, in the first approximate expression determination operation, if a correlation coefficient of the first approximate expression is smaller than a preset second threshold value R1, the bias condition determiner determines the first approximate expression on the basis of the direct current component of the developing current corresponding to a remaining inter-peak voltage obtained by excluding the largest inter-peak voltage among the at least three inter-peak voltages for first measurement. According to this configuration, if the correlation coefficient is small in the process for determining the first approximate expression, it is possible to determine the first approximate expression with further higher accuracy by excluding the data of an inter-peak voltage close to the second measurement range.

In addition, the bias condition determiner preliminarily excludes the largest or smallest inter-peak voltage excluded in the second approximate expression determination operation from the second measurement range and executes a next bias condition determination mode. According to this configuration, the data excluded in the previous bias condition determination mode is excluded in the next bias condition determination mode from the beginning, and the mode execution time thereby can be shortened and a highly accurate reference inter-peak voltage can be determined.

In addition, in the present embodiment, a number of the at least three inter-peak voltages for first measurement in the first measurement range is set to be larger than a number of the at least three inter-peak voltages for second measurement in the second measurement range. According to this configuration, the slope of the first approximate expression is positive, and a relatively large amount of data is obtained in the first measurement range where the developing current is likely to change significantly, and a more accurate reference inter-peak voltage thereby can be determined.

In addition, in the present embodiment, the change point at which the balance (total of each current) of the toner moving current, image portion magnetic brush current, and non-image portion magnetic brush current changes is predicted by the intersection of two approximate expressions, and the reference inter-peak voltage can be determined.

In the present embodiment, the setting of the reference inter-peak voltage is determined on the basis of the developing current. In the past, measuring image density and determining the reference inter-peak voltage from the stability of the image density has been considered. However, for example, the measurement accuracy of a density sensor that measures the image density on the photoconductor drum 20 or the intermediate transfer belt 141 tends to decrease as the image density increases, and the image density in the second measurement range of the present disclosure cannot be detected accurately. From this point as well, it is preferable that the data for determining the reference inter-peak voltage in the first measurement range and the second measurement range is the developing current.

In addition, since the developing current is likely to change significantly in the first measurement range, it is desirable to measure in the widest possible inter-peak voltage range. On the other hand, in the second measurement range, the change in the developing current is relatively small, and if the inter-peak voltage is set excessively large, a leak may occur in the developing nip section. Therefore, it is desirable that the second measurement range is narrower than the first measurement range and set with a small number of measurement points. As a result, it is possible to shorten the mode execution time and reduce the amount of toner consumed.

In addition, the developing current may be measured in a circuit in the developing bias applicator 971. The toner moving current can also be measured on the photoconductor drum 20 side. However, since the photoconductor drum 20 also includes the current flowing from the transfer roller, these currents cannot be separated. Therefore, it is desirable to measure the developing current on the developing bias applicator 971 side.

In addition, in the present embodiment, in the first and second DC calibrations (the first direct current voltage determination mode and the second direct current voltage determination mode), the calibration executor 984 applies the developing bias to the developing roller 231 under a condition that the direct current voltage of the developing bias is each set to a plurality of direct current voltages for measurement, to thereby develop with toner the latent image for measurement into the toner image for measurement and obtain each density of the toner image for measurement detected by the density sensor 100, and determines, as the provisional reference direct current voltage or the reference direct current voltage, a direct current voltage corresponding to a specific target density, from a relation between the plurality of direct current voltages for measurement and a plurality of densities of the toner image for measurement.

According to such a configuration, the direct current voltage corresponding to a specific target density can be easily determined as the provisional reference direct current voltage or the reference direct current voltage from the relation between the plurality of direct current voltages for measurement and the plurality of densities of the toner image for measurement.

While the embodiment of the present disclosure has been described above, the present disclosure is not limited to this, and for example, the following variation can be adopted.

(1) In the above embodiment, an aspect in which the surface of the developing roller 231 is subjected to knurled grooving+blasting has been described. However, the surface of the developing roller 231 may have a recessed shape (dimple)+blasting, or be subjected to blasting only, have a knurled groove only, have a recessed shape (dimple) only, or be subjected to plating processing.

(2) In a case where the image forming apparatus 10 has a plurality of developing devices 23 as illustrated in FIG. 1, the AC calibration according to the above embodiment is performed by one or two developing devices 23, and the result may be used by an other developing device 23.

Figure 12:
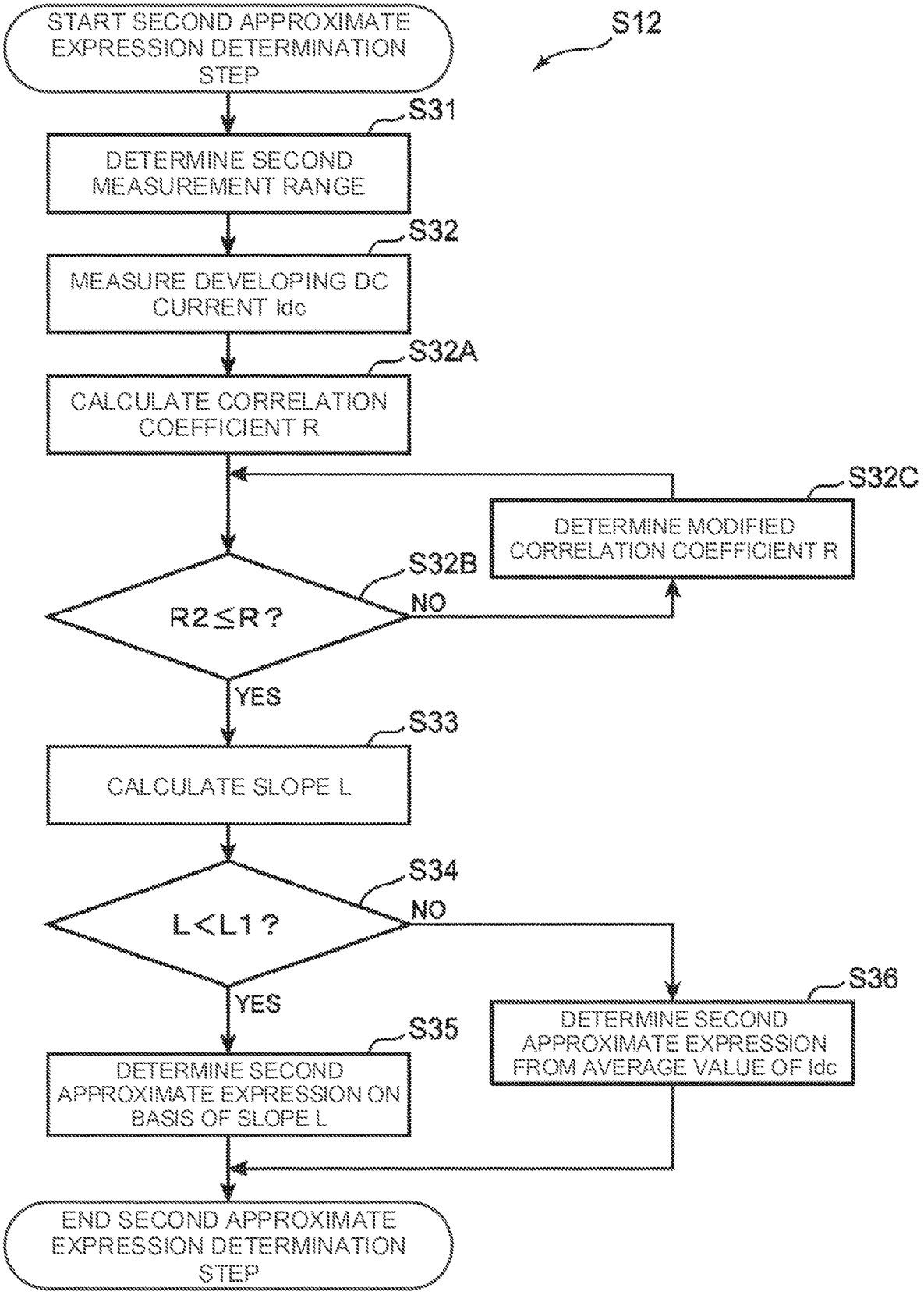
FIG. 12 is a flowchart of the second approximate expression determination step of the AC calibration executed in the image forming apparatus according to a variation of the present disclosure.
Figure 13:
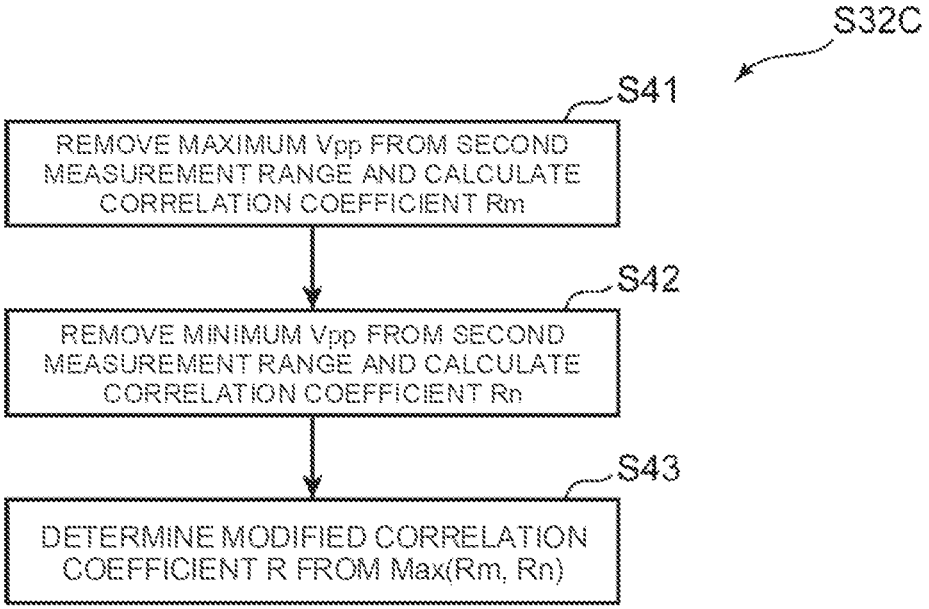
FIG. 13 is a partial flowchart of the second approximate expression determination step of the AC calibration executed in the image forming apparatus according to the variation of the present disclosure.

(3) FIG. 12 is a flowchart of the second approximate expression determination step of the AC calibration executed in the image forming apparatus according to a variation of the present disclosure. FIG. 13 is a partial flowchart of the second approximate expression determination step. In the present variation, steps S32A, S32B, and S32C in FIG. 12 are different from those in the previous embodiment. That is, a developing DC current Idc is measured in step S32. In doing so, in the present variation, as is the case with the first approximate expression determination step, four developing currents corresponding to the four inter-peak voltages for second measurement are obtained, and four sets of data regarding the inter-peak voltages for second measurement and the developing current are obtained.

Here, the calibration executor 984 calculates the correlation coefficient R in the same manner as that in the first approximate expression determination step (step S32A). Then, the calibration executor 984 compares the magnitude relation between the correlation coefficient R and the threshold value R2 stored in advance in the storage unit 983 (step S32B). As an example, the threshold value R2 is set to 0.90. Here, if the threshold value R2 correlation coefficient R (YES in step S32B), as in the previous embodiment, the calibration executor 984 calculates the slope L in step S33, and calculates each second approximate expression in step S35 or step S36, on the basis of the determination result in step S34. On the other hand, in step S32B, if R2>R (NO in step S32B), the calibration executor 984 determines a modified correlation coefficient R of step S32C.

Referring to FIG. 13, when the determination step of the modified correlation coefficient R is started, the calibration executor 984 removes the largest Vpp data among the above four sets of data and calculates a correlation coefficient Rm on the basis of the remaining three pieces of data (step S41). Next, the calibration executor 984 removes the smallest Vpp data among the above four sets of data and calculates a correlation coefficient Rn on the basis of the remaining three pieces of data (step S42). Then, the calibration executor 984 compares the magnitude relation of the correlation coefficients Rm and Rn calculated above, and selects the larger correlation coefficient as the modified correlation coefficient R (step S43). After that, returning to FIG. 12, the processing subsequent to step S32B is repeated on the basis of the selected modified correlation coefficient R.

As described above, in the present variation, if the correlation coefficient is small in the second approximate expression determination step, the data having a high correlation coefficient is selected, and the second approximate expression is set on the basis of the data. Therefore, by excluding the data of at least one inter-peak voltage, a more accurate second approximate expression can be determined.

In particular, the calibration executor 984 compares, a correlation coefficient Rm of an approximate expression for second determination determined on the basis of the direct current component of the developing current corresponding to a remaining inter-peak voltage obtained by excluding the largest inter-peak voltage among the at least three inter-peak voltages for second measurement, with a correlation coefficient Rn of an approximate expression for third determination determined on the basis of the direct current component of the developing current corresponding to a remaining inter-peak voltage obtained by excluding the smallest inter-peak voltage among the at least three inter-peak voltages for second measurement, and determines, as the second approximate expression, an approximate expression for determination having a larger correlation coefficient out of the approximate expression for second determination and the approximate expression for third determination. According to this configuration, if the correlation coefficient is small in the process for determining the second approximate expression, either the data of the smallest inter-peak voltage in the second measurement range closest to the first measurement range or the data of the maximum inter-peak voltage that is prone to generate a discharge leak and include noise is excluded, and a more accurate second approximate expression thereby can be determined.

Figure 14:
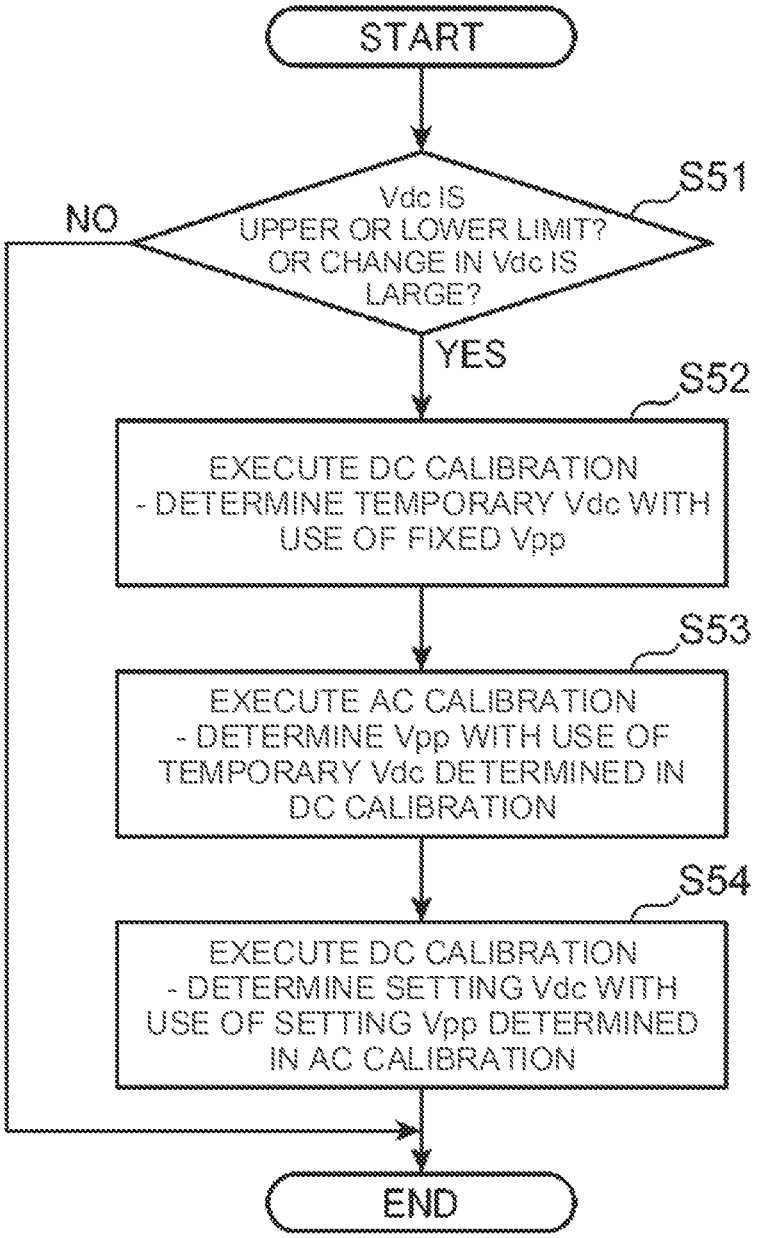
FIG. 14 is a flowchart of the developing bias calibration executed in the image forming apparatus according to a variation of the present disclosure.

(4) FIG. 14 is a flowchart of the developing bias calibration executed in the image forming apparatus 10 according to a variation of the present disclosure. In this variation, the determination process for determining the execution of the developing bias calibration is different from that in the flowchart illustrated in FIG. 4. That is, in FIG. 4, the case where the number of prints in the image forming apparatus 10 exceeds a specific threshold value has been described as the calibration start condition. However, in the present variation, the developing bias calibration is executed if the Vdc1 determined in the DC calibration executed immediately before is less than the VdcL or more than the VdcH mentioned above, or if the difference between the Vdc1 determined in the previous DC calibration and the Vdc1 determined in the current (immediately preceding) DC calibration exceeds a preset threshold value. In step S52 in FIG. 14, the DC calibration is executed with the use of the fixed Vpp set in advance and stored in the storage unit 983. Steps S53 and S54 are the same as steps S03 and S04 in FIG. 4. According to the present variation, when there is a possibility that an abnormality has occurred in the Vdc1 determined in the DC calibration, the developing bias calibration is executed throughout, and the abnormal Vdc1 is prevented from forming an image on the sheet P.

Figure 15:
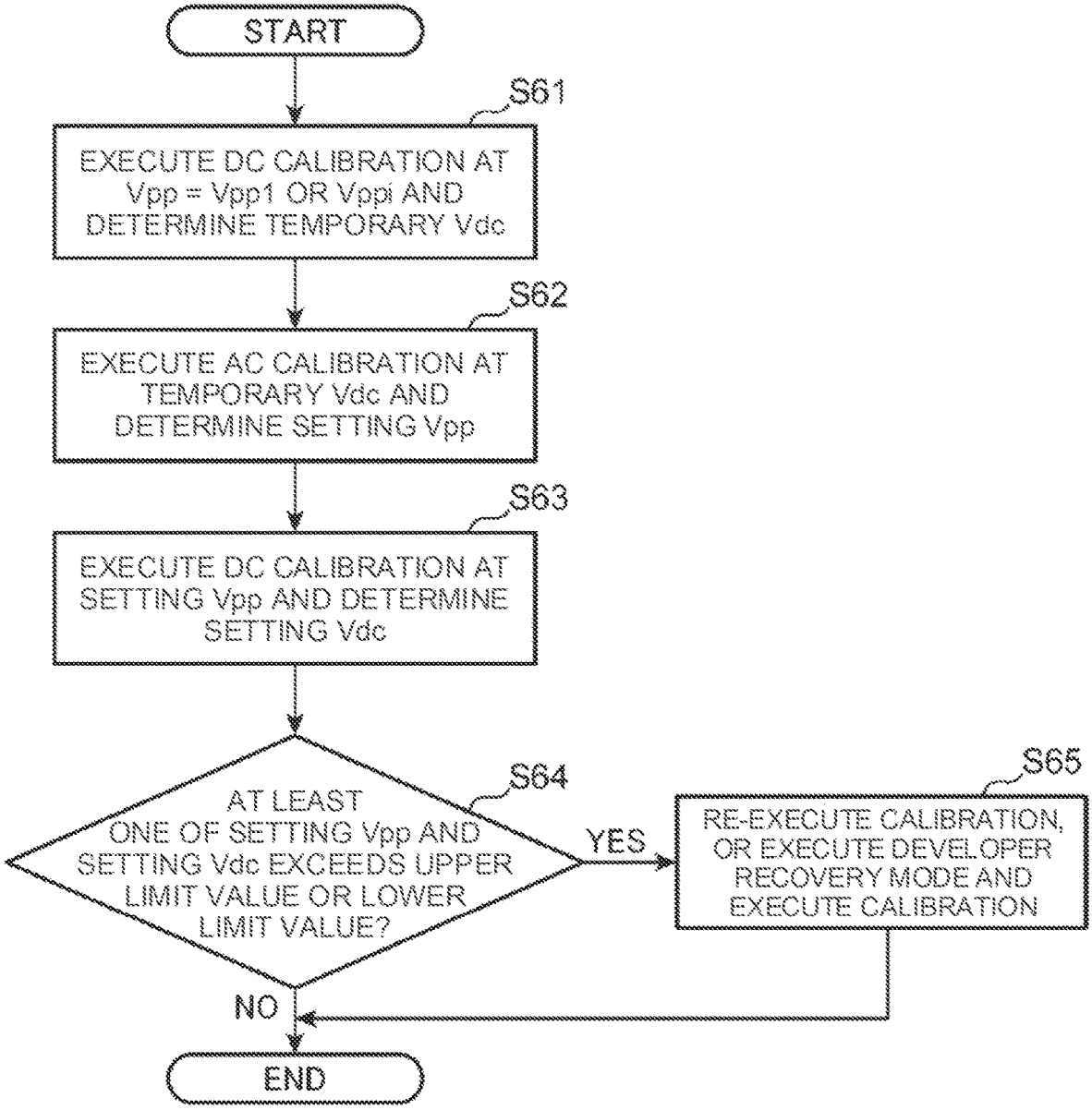
FIG. 15 is a flowchart of the developing bias calibration executed in the image forming apparatus according to a variation of the present disclosure.

(5) FIG. 15 is a flowchart of the developing bias calibration executed in the image forming apparatus 10 according to a variation of the present disclosure. As compared with the flowchart of FIG. 4, the present variation differs in that the determination process for determining the execution of the developing bias calibration is not included, and that the abnormalities of the determined Vpp (set Vpp) and the determined Vdc (set Vdc) are determined. As illustrated in FIG. 15, the developing bias calibration may be executed without going through the determination process. As an example, the developing bias calibration is executed when the power of the image forming apparatus 10 is turned on or by the command of a maintenance worker. In FIG. 15, the DC calibration, AC calibration, and DC calibration are executed in steps S61, S62, and S63, respectively. Then, in step S64, the calibration executor 984 determines whether at least one of the set Vpp and the set Vdc exceeds the upper limit value or the lower limit value respectively set in advance. If both the set Vpp and the set Vdc are included between the upper limit value and the lower limit value (NO in step S64), there is no abnormality and the developing bias calibration is terminated. On the other hand, if at least one of the set Vpp and the set Vdc exceeds the preset upper limit value or lower limit value (YES in step S64), the developing bias calibration is re-executed or a developer recovery mode is executed, and then the developing bias calibration is executed again (step S65). Here, in the developer recovery mode, it is considered that the chargeability of the toner in the developing device 23 is lowered. Thus, an image for forcibly consuming the toner is formed on the photoconductor drum 20 to discharge the toner from the developing device 23, and the toner replenisher 15 replenishes the consumed toner to the developing device 23. In the present variation as well, the abnormal set Vpp or set Vdc is prevented from forming an image on the sheet P, and the abnormal set Vpp or set Vdc is be prevented from being derived due to the decrease in the chargeability of the toner.

Figure 16:
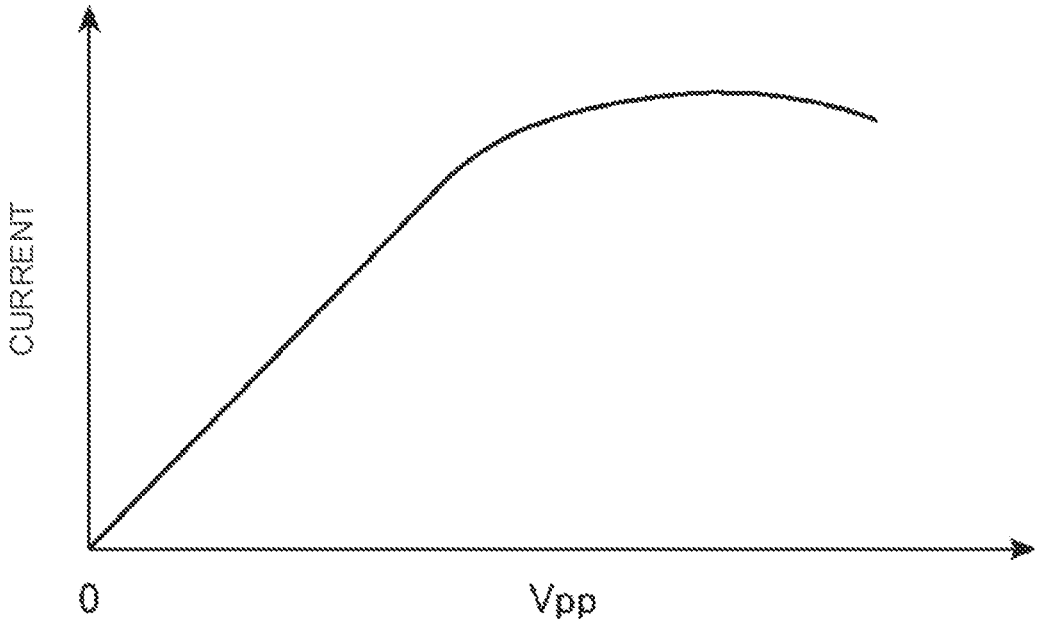
FIG. 16 is a graph indicating the relation between the Vpp of the AC bias and the developing current for explaining the AC calibration executed in the image forming apparatus according to the variation of the present disclosure.

(6) FIG. 16 is a graph indicating the relation between the Vpp of the AC bias and the developing current for explaining the AC calibration executed in the image forming apparatus 10 according to the variation of the present disclosure. In the AC bias calibration according to the previous embodiment, an aspect in which the reference inter-peak voltage is set from the intersection of the first approximate expression and the second approximate expression, which represent the relation between the inter-peak voltage (Vpp) of the alternating current bias and the developing current. The present disclosure is not limited to this. If the developing current when the latent image for measurement is developed into the toner image for measurement is measured corresponding to each Vpp while changing the Vpp, the graph of the relation such as that illustrated in FIG. 16 can be obtained. Here, the calibration executor 984 may determine the reference inter-peak voltage by obtaining the Vpp at which the developing current is maximum, or by obtaining the Vpp at which the slope of the tangent line of the graph in FIG. 16 is zero. In addition, in the AC calibration according to the previous embodiment, the image for measurement is formed with the use of the solid image, but the image for measurement may be formed with the use of a halftone image. Furthermore, the density of the image for measurement including the halftone image may be detected by the density sensor 100, and an inter-peak voltage at which a specific image density can be obtained may be determined as the reference inter-peak voltage from the relation between the plurality of inter-peak voltages and the corresponding plurality of image densities.

As described above, in the present variation, in the AC calibration (inter-peak voltage determination mode), the calibration executor 984 applies the developing bias to the developing roller 231 under a condition that the inter-peak voltage of the alternating current voltage of the developing bias is each set to a plurality of inter-peak voltages for measurement, to thereby obtain each direct current component of the developing current detected by the ammeter 973 when the latent image for measurement is developed into the toner image for measurement, and determines the reference inter-peak voltage from a relation between the plurality of inter-peak voltages for measurement and a plurality of direct current components of the developing current. Therefore, the reference inter-peak voltage can be easily determined from the relation between the plurality of inter-peak voltages for measurement and the plurality of direct current components of the developing current.

In the AC calibration, the calibration executor 984 may determine, as the reference inter-peak voltage, an inter-peak voltage corresponding to a maximum value of the direct current component of the developing current in a graph indicating the relation between the plurality of inter-peak voltages for measurement and the plurality of direct current components of the developing current. In this case, since the inter-peak voltage corresponding to the maximum value of the direct current component of the developing current is determined as the reference inter-peak voltage, the reference inter-peak voltage can be easily determined.

In addition, in the AC calibration, the calibration executor 984 may determine, as the reference inter-peak voltage, an inter-peak voltage corresponding to a point where a slope in a graph indicating the relation between the plurality of inter-peak voltages for measurement and the plurality of direct current components of the developing current is zero. In this case, since the calibration executor 984 determines, as the reference inter-peak voltage, an inter-peak voltage corresponding to a point where a slope in a graph indicating the relation between the plurality of inter-peak voltages for measurement and the plurality of direct current components of the developing current is zero, the reference inter-peak voltage can be easily determined.

EXAMPLE

Hereinafter, the developing bias calibration in the present embodiment will be described in more detail on the basis of the data. The data described below is based on the following conditions.

<Common Conditions>

- print speed: 55 sheets/minute
- photoconductor drum 20: amorphous silicon photoconductor (α-Si)
- developing roller 231: outer diameter 20 mm, surface shape of knurled grooving+blasting (80 rows of recesses (grooves) are formed along the circumferential direction)
- regulation blade 234: made of SUS430, magnetic, thickness 1.5 mm
- developer conveyance volume after regulation blade 234: 250 $g/m^2$
- peripheral speed of the developing roller 231 with respect to the photoconductor drum 20: 1.8 (trail direction at the facing position)
- distance between the photoconductor drum 20 and developing roller 231: 0.25 mm
- white background (background) potential of photoconductor drum 20 V0: +250 V
- image portion potential of the photoconductor drum 20 VL: +10 V
- developing bias of the developing roller 231: frequency=10 kHz, Duty=50% alternating current voltage square wave (Vpp is adjusted in accordance with each experimental condition), Vdc (direct current voltage)=150 V
- toner: positively charged polar toner, volume average particle diameter 6.8 μm, toner density 6%
- carrier: volume average particle diameter 35 μm, ferrite/resin coat carrier <Developer>

The same effect has been confirmed regardless of whether the toner is a crushed toner or a toner with a core shell structure. It has been also confirmed that the same effect is exhibited in the range of 3% to 12% for the toner density. The finer the magnetic brush, the more prominent the movement of the toner due to the alternating electric field. Thus, the volume average particle diameter of the carrier is preferably 45 μm or less, and more preferably 30 μm or more and 40 μm or less. In addition, a resin carrier having a smaller true specific gravity is more preferable than a ferrite carrier.

<Carrier>

The carrier is a ferrite core with a volume average particle diameter of 35 μm coated with silicone, fluorine, or the like. Specifically, the carrier has been created by the following procedure. The coating liquid is prepared by dissolving 20 parts by mass of silicone resin KR-271 (manufactured by Shin-Etsu Chemical Co., Ltd.) in 200 parts by mass of toluene in 1000 parts by weight of carrier core EF-35 (manufactured by Powdertech Co., Ltd.). Then, after spray-coating the coating liquid by a fluidized bed coating device, heat treatment was performed at 200° C. for 60 minutes to obtain a carrier. In this coating liquid, a conductive agent and a charge control agent are respectively mixed with 100 parts of the coat resin in the range of 0 to 20 parts and dispersed to adjust the resistance and charge.

<Evaluation Result>

Table 7 illustrates the results of three comparative experiments: an example, a comparative example 1, and a comparative example 2, under the above-mentioned experimental conditions.

the charge amount of the developer decreases. However, this decrease is not due to the fundamental decrease in the charging characteristics of the developer, but is a temporary decrease due to the high temperature and high humidity environment. Therefore, the toner charge amount gradually recovers in the subsequent printing process at room temperature. However, if the decrease and recovery of this toner charge amount is overlooked, the developing bias conditions (Vdc, Vpp) that do not match the chargeability of the latest developer will be set, and image defects will occur. The three experiments in FIG. 7 explain this point.

Specifically, in comparative example 1 and comparative example 2, since the provisional Vpp and the provisional Vdc are not set as in the example, a deviation is likely to occur between the set bias and the toner charge amount. In comparative example 1 illustrated in FIG. 8, the toner charge amount is low in an unattended environment, and thus the development performance is high, and the Vpp is set very low in the AC calibration to compensate for this. As described above, if the toner charge amount is low and the set Vpp is low, the half image pitch unevenness tends to deteriorate. For this reason, in comparative example 1, the half image pitch unevenness has deteriorated compared to the example. In addition, if 1000 endurance prints are performed in this state under a usage environment, the toner charge amount will increase, and thus, along with this, it will be normally necessary to set the Vpp and Vdc higher. However, in comparative example 1, since the Vpp is set low as described above, the image density is maintained by

TABLE 7

| | | Room Temp. Print | High Temp. and High Humidity | Room Temperature | | | | | |
|---|---|---|---|---|---|---|---|---|---|
| | | | | Calibration | | | | After Printing 1000 sheets | |
| | Env. | Before Calib. | Env. Stopped | DC Calib. | AC Calib. | DC Calib. | Print | DC Calib. | Other |
| Example | Vpp | 1200 | — | 1000 | 920 | 920 | — | 920 | |
| DC→AC→DC Calib. | Vdc | 118 | — | 84 | 84 | 96 | — | 124 | |
| Comp. Ex. 1 | Vpp | 1200 | — | | 700 | 700 | — | 700 | |
| AC→DC Calib. | Vdc | 118 | — | | 118 | 154 | — | 200 | Vdc: Upper Limit Value |
| Comp. Ex. 2 | Vpp | 1200 | — | | | 1200 | — | | Gradation After Calibration: Deteriorated |
| Only DC Calib. | Vdc | 118 | — | | | 67 | — | | |

In each experiment, first, printing is performed at room temperature before calibration at a printing rate of 5% and 5 sheets are intermittently printed. In doing so, Vpp=1200 (V) and Vdc=118 (V) are set for each experiment. After that, the image forming apparatus 10 is left for a specific time (for example, overnight) in a high temperature and high humidity environment. After that, a prescribed calibration is executed at room temperature. Specifically, in the example, the DC calibration, AC calibration, and DC calibration are executed in order. In comparative example 1, the AC calibration and the DC calibration are executed in order. In comparative example 2, only the DC calibration is executed. After that, 1000 sheets are printed at a printing rate of 5% and 5 sheets are intermittently printed, and then the DC calibration is executed. Table 7 illustrates the Vpp or Vdc determined by each calibration being performed. In each experiment, the Vpp when the DC calibration is executed is fixed at 1000 (V).

In each experiment, if the image forming apparatus 10 is left in a high temperature and high humidity environment, increasing only the Vdc in the DC calibration, and compared to the example in which the Vpp is also set higher, the Vdc reaches a preset upper limit value at an early stage. In this state, it becomes difficult to secure the image density in comparative example 1. This result is more remarkable in comparative example 2 in which only the DC calibration is performed. That is, in comparative example 2, the DC bias (Vdc) after the DC calibration is even smaller than that in comparative example 1. In addition, in comparative example 2, since the AC calibration has not been performed, the Vpp is too high for the toner charge amount, resulting in deterioration of the gradation after calibration. On the other hand, in the embodiment corresponding to the present disclosure, since the DC calibration, AC calibration, and DC calibration again are executed, the optimum Vdc and Vpp according to the toner charge amount have been set and the image quality has been maintained high.

What is claimed is:

1. An image forming apparatus capable of performing an image forming operation for forming an image on a sheet, the image forming apparatus comprising:

an image carrier including a surface that is rotated to allow an electrostatic latent image to be formed and carries a toner image in which the electrostatic latent image is actualized by toner;

a charging device charging the image carrier to a specific charging potential;

an exposure device that is disposed on a downstream side in a rotation direction of the image carrier with respect to the charging device, and forms the electrostatic latent image by exposing a surface of the image carrier charged to the charging potential in accordance with specific image information;

a developing device that is disposed to face the image carrier in a specific developing nip section on the downstream side in the rotation direction with respect to the exposure device, the developing device including a developing roller that includes a peripheral surface rotated and carrying a developer including toner and carrier, and forms the toner image by supplying toner to the image carrier;

a transferer that transfers the toner image carried on the image carrier to a sheet;

a developing bias applicator capable of applying a developing bias in which an alternating current voltage is superimposed on a direct current voltage to the developing roller;

a current detector capable of detecting a direct current component of a developing current flowing between the developing roller and the developing bias applicator;

a density detector capable of detecting a density of the toner image; and a bias condition determiner that executes a bias condition determination mode for determining a reference voltage that is a reference for each of an inter-peak voltage of the alternating current voltage of the developing bias applied to the developing roller in the image forming operation and the direct current voltage, on a basis of the direct current component of the developing current detected by the current detector or a density of a toner image for measurement detected by the density detector when the developing bias is applied to the developing roller corresponding to a specific latent image for measurement formed on the image carrier to develop with toner the latent image for measurement into the toner image for measurement, wherein the bias condition determiner can execute, as the bias condition determination mode, each of:

a first direct current voltage determination mode for determining a provisional reference direct current voltage that is a provisional reference for the direct current voltage of the developing bias applied to the developing roller, on a basis of the density of the toner image for measurement, detected by the density detector;

an inter-peak voltage determination mode executed after the first direct current voltage determination mode, the inter-peak voltage determination mode being for determining a reference inter-peak voltage that is a reference for the inter-peak voltage of the alternating current voltage of the developing bias applied to the developing roller in the image forming operation, on a basis of the direct current component of the developing current detected by the current detector or a density of a toner image for measurement detected by the density detector when the developing bias including the provisional reference direct current voltage is applied to the developing roller to develop, with toner, the latent image for measurement into the toner image for measurement; and a second direct current voltage determination mode executed after the inter-peak voltage determination mode, the second direct current voltage determination mode being for determining a reference direct current voltage that is a reference for the direct current voltage of the developing bias applied to the developing roller in the image forming operation, on a basis of a density of a toner image for measurement detected by the density detector when the developing bias including the reference inter-peak voltage is applied to the developing roller to develop with toner the latent image for measurement into the toner image for measurement.

2. The image forming apparatus according to claim 1, wherein the bias condition determiner executes, in the inter-peak voltage determination mode, each of:

a first approximate expression determination operation for obtaining each direct current component of the developing current under a condition that the inter-peak voltage of the alternating current voltage of the developing bias is each set to at least three inter-peak voltages for first measurement included in a specific first measurement range, and determining a first approximate expression that is a primary approximate expression indicating a relation between the inter-peak voltage for first measurement in the first measurement range and the obtained direct current component of the developing current;

a second approximate expression determination operation for obtaining each direct current component of the developing current under a condition that the inter-peak voltage of the alternating current voltage of the developing bias is each set to at least three inter-peak voltages for second measurement included in a second measurement range set to have a minimum value larger than a maximum value of the first measurement range, and determining a second approximate expression that is a primary approximate expression indicating a relation between the inter-peak voltage for second measurement in the second measurement range and the obtained direct current component of the developing current; and a reference voltage determination operation for determining, as the reference inter-peak voltage, an inter-peak voltage at an intersection where the first approximate expression determined by the first approximate expression determination operation and the second approximate expression determined by the second approximate expression determination operation intersect each other.

3. The image forming apparatus according to claim 2, wherein the bias condition determiner determines the first approximate expression by a least-squares method from the direct current component of the developing current each obtained at the at least three inter-peak voltages for first measurement included in the first measurement range.

4. The image forming apparatus according to claim 2, wherein if a slope of an approximate expression for first determination, that is a primary approximate expression determined by a least-squares method from the direct current component of the developing current each obtained at the at least three inter-peak voltages for second measurement included in the second measurement range is greater than a preset first threshold value, the bias condition determiner sets, as the second approximate expression, a linear expression in which an average value of the direct current component of the developing current each obtained at the at least three inter-peak voltages for second measurement is constant with respect to a change in an inter-peak voltage, and if the slope of the approximate expression for first determination is smaller than the first threshold value, the bias condition determiner sets the approximate expression for first determination as the second approximate expression.

5. The image forming apparatus according to claim 2, wherein an interval between a plurality of the inter-peak voltages for first measurement in the first measurement range and an interval between a plurality of the inter-peak voltages for second measurement in the second measurement range are respectively set to be smaller than an interval between the maximum value in the first measurement range and the minimum value in the second measurement range.

6. The image forming apparatus according to claim 2, wherein in the first approximate expression determination operation, if a correlation coefficient of the approximate expression is smaller than a preset second threshold value, the bias condition determiner determines the first approximate expression on a basis of the direct current component of the developing current corresponding to a remaining inter-peak voltage obtained by excluding at least one inter-peak voltage from the at least three inter-peak voltages for first measurement.

7. The image forming apparatus according to claim 6, wherein in the first approximate expression determination operation, if a correlation coefficient of the first approximate expression is smaller than the second threshold value, the bias condition determiner determines the first approximate expression on a basis of the direct current component of the developing current corresponding to a remaining inter-peak voltage obtained by excluding the largest inter-peak voltage among the at least three inter-peak voltages for first measurement.

8. The image forming apparatus according to claim 2, wherein in the second approximate expression determination operation, if a correlation coefficient of the second approximate expression is smaller than a preset third threshold value, the bias condition determiner determines the second approximate expression on a basis of the direct current component of the developing current corresponding to a remaining inter-peak voltage obtained by excluding at least one inter-peak voltage from the at least three inter-peak voltages for second measurement.

9. The image forming apparatus according to claim 8, wherein in the second approximate expression determination operation, if a correlation coefficient of the second approximate expression is smaller than the third threshold value, the bias condition determiner compares, a correlation coefficient of an approximate expression for second determination determined on a basis of the direct current component of the developing current corresponding to a remaining inter-peak voltage obtained by excluding the largest inter-peak voltage among the at least three inter-peak voltages for second measurement, with a correlation coefficient of an approximate expression for third determination determined on a basis of the direct current component of the developing current corresponding to a remaining inter-peak voltage obtained by excluding the smallest inter-peak voltage among the at least three inter-peak voltages for second measurement, and determines, as the second approximate expression, an approximate expression for determination having a larger correlation coefficient out of the approximate expression for second determination and the approximate expression for third determination.

10. The image forming apparatus according to claim 9, wherein the bias condition determiner preliminarily excludes the largest or smallest inter-peak voltage excluded in the second approximate expression determination operation from the second measurement range and executes a next bias condition determination mode.

11. The image forming apparatus according to claim 2, wherein a number of the at least three inter-peak voltages for first measurement in the first measurement range is set to be larger than a number of the at least three inter-peak voltages for second measurement in the second measurement range.

12. The image forming apparatus according to claim 2, wherein the bias condition determiner obtains, a change point where a balance of three currents constituting the direct current component of the developing current changes in response to a change in the inter-peak voltage, by an intersection of the first approximate expression and the second approximate expression, and determines an inter-peak voltage corresponding to the change point as the reference inter-peak voltage, the three currents being: a toner moving current generated by a movement of toner from the developing roller to the image carrier in an image forming portion of the developing nip section; an image portion magnetic brush current flowing in a same direction as a direction of the toner moving current along a magnetic brush formed by the toner and the carrier so as to straddle the developing roller and the image carrier in the image forming portion; and a non-image portion magnetic brush current flowing in a direction opposite to the direction of the toner moving current along a magnetic brush formed by the toner and the carrier so as to straddle the developing roller and the image carrier in a non-image forming portion of the developing nip section.

13. The image forming apparatus according to claim 1, wherein in the inter-peak voltage determination mode, the bias condition determiner applies the developing bias to the developing roller under a condition that the inter-peak voltage of the alternating current component of the developing bias is each set to a plurality of inter-peak voltages for measurement, to thereby obtain each direct current component of the developing current detected by the current detector when the latent image for measurement is developed into the toner image for measurement, and determines the reference inter-peak voltage from a relation between the plurality of inter-peak voltages for measurement and a plurality of direct current components of the developing current.

14. The image forming apparatus according to claim 13, wherein in the inter-peak voltage determination mode, the bias condition determiner determines, as the reference inter-peak voltage, an inter-peak voltage corresponding to a maximum value of the direct current component of the developing current in a graph indicating the relation between the plurality of inter-peak voltages for measurement and the plurality of direct current components of the developing current.

15. The image forming apparatus according to claim 13, wherein in the inter-peak voltage determination mode, the bias condition determiner determines, as the reference inter-peak voltage, an inter-peak voltage corresponding to a point where a slope in a graph indicating the relation between the plurality of inter-peak voltages for measurement and the plurality of direct current components of the developing current is zero.

16. The image forming apparatus according to claim 1, wherein in the first direct current voltage determination mode and the second direct current voltage determination mode, the bias condition determiner applies the developing bias to the developing roller under a condition that the direct current voltage of the developing bias is each set to a plurality of direct current voltages for measurement, to thereby develop with toner the latent image for measurement into the toner image for measurement and obtain each density of the toner image for measurement detected by the density detector, and determines, as the provisional reference direct current voltage or the reference direct current voltage, a direct current voltage corresponding to a specific target density, from a relation between the plurality of direct current voltages for measurement and a plurality of densities of the toner image for measurement.

* * * * *